US008227973B2

(12) United States Patent
Yamazaki et al.

(10) Patent No.: US 8,227,973 B2
(45) Date of Patent: Jul. 24, 2012

(54) DISPLAY PANEL, DISPLAY APPARATUS, AND TELEVISION APPARATUS FOR PERFORMING DISPLAY USING LIGHT EMISSION

(75) Inventors: Koji Yamazaki, Ayase (JP); Kinya Kamiguchi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 12/820,026

(22) Filed: Jun. 21, 2010

(65) Prior Publication Data

US 2010/0328543 A1 Dec. 30, 2010

(30) Foreign Application Priority Data

Jun. 24, 2009 (JP) ..... 2009-149798
Jun. 1, 2010 (JP) ..... 2010-125990

(51) Int. Cl.
*H01J 1/62* (2006.01)
*H01J 63/04* (2006.01)

(52) U.S. Cl. ..... 313/495; 313/496; 313/497; 315/169.3

(58) Field of Classification Search ..... 313/495–497
See application file for complete search history.

(56) References Cited

U.S. PATENT DOCUMENTS 6,114,804 A 9/2000 Kawase
6,476,547 B1 11/2002 Kawase
6,885,156 B2 4/2005 Tajimo
7,282,852 B2 10/2007 Tajimo
7,786,664 B2 * 8/2010 Kobayashi ..... 313/495
2003/0025443 A1 2/2003 Kamiguchi
2004/0061697 A1 4/2004 Yoshino
2005/0046332 A1 3/2005 Tajima
2006/0189243 A1 * 8/2006 Kishi et al. ..... 445/24
2006/0267477 A1 * 11/2006 Hirasawa et al. ..... 313/495
2010/0277652 A1 * 11/2010 Hori et al. ..... 348/725

FOREIGN PATENT DOCUMENTS

JP 2003-092075 A 3/2003
JP 2003-115271 A 4/2003
JP 2004-139978 A1 5/2004
JP 2006-222093 A 8/2006
JP 2007-109603 A 4/2007
JP 2008-108566 A 5/2008
JP 2008-305739 A 12/2008

OTHER PUBLICATIONS

Machine English translation of JP 2007109603 to Onishi.*

* cited by examiner

*Primary Examiner* — Sikha Roy
(74) *Attorney, Agent, or Firm* — Canon U.S.A., Inc., IP Division

(57) ABSTRACT

A conductive member is provided, surrounding a terminal, on a substrate so that a portion of the conductive member is positioned between wiring and the terminal. The conductive member includes, at an inner edge thereof, multiple portions whose distances from the terminal are different. The multiple portions include a portion whose distance from the terminal is shorter than that of a portion among the plurality of portions that is closest to the wiring.

18 Claims, 8 Drawing Sheets

DISPLAY PANEL, DISPLAY APPARATUS, AND TELEVISION APPARATUS FOR PERFORMING DISPLAY USING LIGHT EMISSION

BACKGROUND OF THE INVENTION

1. Field of the Invention

The present invention relates to a display panel that performs display by accelerating electrons and causing the electrons to collide with light-emitting members.

2. Description of the Related Art

A flat display panel using cathode luminescense includes a rear plate and a face plate that are disposed so as to face each other. The rear plate has electron-emitting devices and wiring, and the face plate has light-emitting members such as phosphors and an anode. The space between the rear plate and the face plate is maintained as a vacuum.

The electron-emitting devices driven via the wiring emit electrons. A high potential relative to a ground potential, ranging from a few kV to a few tens of kV, is externally applied to the anode through an anode terminal. The emitted electrons are accelerated by this potential and collide with the light-emitting members, thereby causing the light-emitting members to emit light. Display can be performed using this light emission (cathode luminescense).

At the same time, since the anode terminal is set to a high potential, unintended discharge (abnormal discharge) may occur near the anode terminal.

Japanese Patent Laid-Open No. 2006-222093 discloses an electron beam device that suppresses abnormal discharge by providing independent wiring near a potential supplying path.

SUMMARY OF THE INVENTION

According to an aspect of the present invention, a display panel includes an insulating substrate, wiring connected to an electron-emitting devices on the substrate, an anode and light-emitting members facing the electron-emitting device, a terminal that penetrates through the substrate and is connected to the anode, and a conductive member whose portion is positioned in a region between the wiring and the terminal, the conductive member being provided on the substrate so as to surround the terminal. The terminal is set to an anode potential, and the conductive member is set to a potential lower than the anode potential. The conductive member includes, at an inner edge thereof, a plurality of portions whose distances from the terminal are different, and the plurality of portions include a portion whose distance from the terminal is shorter than that of a portion among the plurality of portions that is closest to the wiring.

Further features of the present invention will become apparent from the following description of exemplary embodiments with reference to the attached drawings.

DESCRIPTION OF THE EMBODIMENTS

Figure 1A:
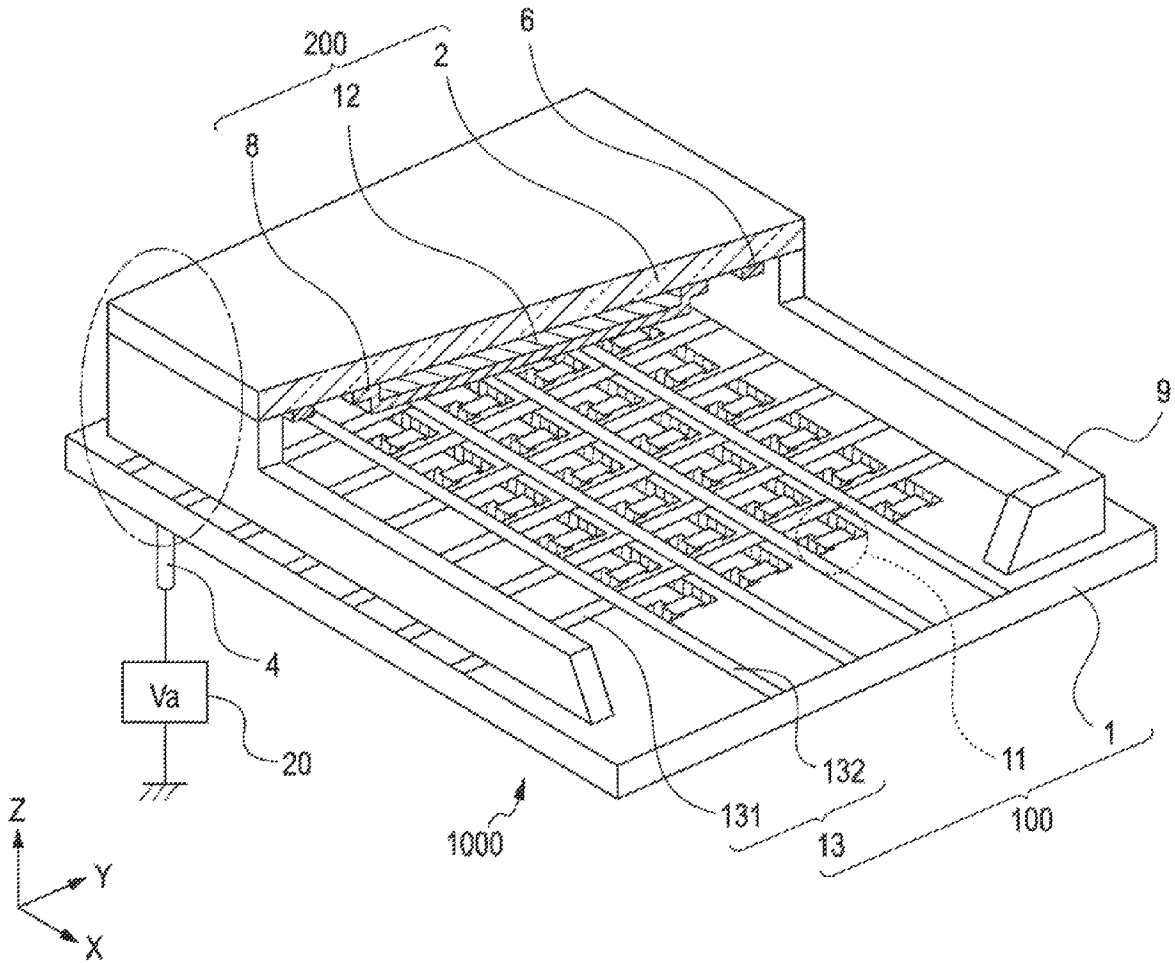
FIGS. 1A to 1C are schematic diagrams illustrating a display apparatus according to an embodiment of the present invention.
Figure 1B:
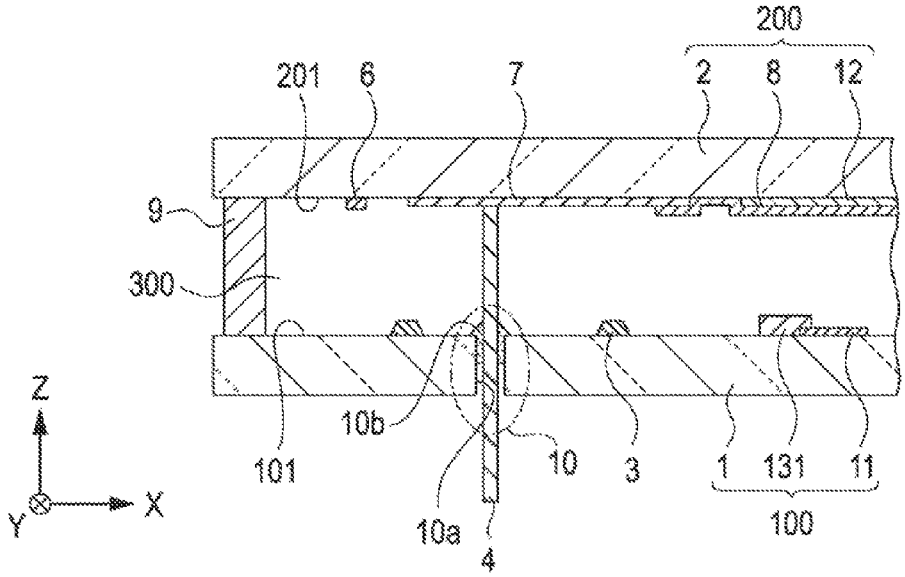
Figure 1C:
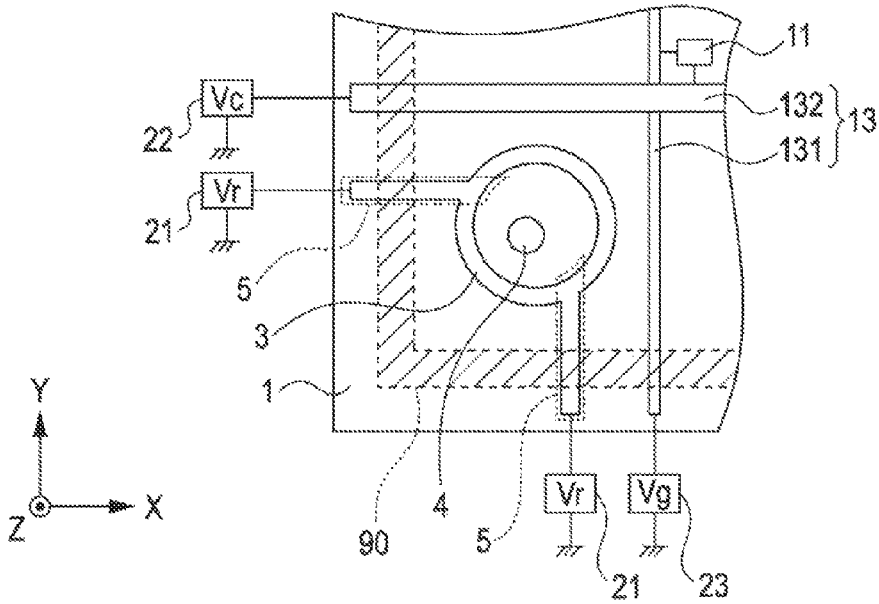

Hereinafter, an embodiment of the present invention will be described using FIGS. 1A to 6. An example of a display apparatus according to an embodiment the present invention will now be described using FIGS. 1A to 1C. FIG. 1A is a perspective view that schematically illustrates the display apparatus (a portion of a display panel is cut out). FIG. 1B is a schematic diagram illustrating the structure of a characteristic portion of the display panel, that is, a X-Z cross section of a portion surrounded by a broken ellipse illustrated in FIG. 1A, which is enlarged in FIG. 1B. FIG. 1C is a schematic diagram illustrating the structure of a characteristic portion of the embodiment of the present invention, that is, an X-Y plan view of the portion illustrated in FIG. 1B. In FIGS. 1A to 1C, the X-direction and the Y-direction are parallel to a surface 101 (principal surface) of a first substrate 1, and the Z-direction is perpendicular to the surface 101 of the first substrate 1. In FIGS. 1A to 1C, the same members or members that have the same function are illustrated using a common reference numeral.

The display apparatus at least includes a display panel 1000, an anode-potential setting unit 20, a prescribed-potential setting unit 21, and a drive circuit.

The display panel 1000 will now be described. The display panel 1000 includes a rear plate 100 and a face plate 200 that are disposed so as to face each other. The space (inner space 300) between the rear plate 100 and the face plate 200 is a vacuum (pressure lower than the atmospheric pressure). Specifically, the inner space 300 is maintained as a vacuum by using a hermetical-sealed container including the real plate 100, the face plate 200, and a frame member 9. In other words, the display panel 1000 is also a hermetically-sealed container (vacuum container) in which the inner space 300 is maintained as a vacuum.

The rear plate 100 at least includes the first substrate 1, which is an insulating substrate, electron-emitting devices 11 provided on the surface 101 of the first substrate 1, and wiring 13. In FIG. 1A, one electron-emitting device 11 is illustrated by being surrounded by a dotted line. The surface 101 of the first substrate 1 is the surface of the first substrate 1, facing the inner space 300. As the first substrate 1, at least the surface thereof is required to have an insulating property. A glass substrate or a substrate on which an insulating layer is provided may be preferably used as the first substrate 1.

In the embodiment of the present invention, an "insulating" member is a member whose volume resistivity is greater than that of a "conductive" member. Practically, a member made of a material having a volume resistivity of $10^6$ Ωm or greater is preferably used as an "insulating" member. Also, a member made of a material having a volume resistivity of $10^{-3}$ Ωm or less is preferably used as a "conductive" member. More preferably, a member made of a material having a volume resistivity of $10^{-5}$ Ωm or less is used as a "conductive" member. Note that "wiring", "electrodes", and "terminals" are conductive members. Hereinafter, a "potential" is described as a value based on the ground potential serving as a reference potential (0 V).

Typically, many, such as a million or more electron-emitting devices 11 are arranged in a matrix. Each of the electron-emitting devices 11 at least includes a cathode, and, if necessary, a gate that controls emission of electrons from the cathode.

The wiring 13 is connected to the electron-emitting devices 11 in the inner space 300. Also, the wiring 13 extends toward the edge of the first substrate 1 and extracted to the outer space. When many electron-emitting devices 11 are arranged in a matrix, matrix wiring including multiple column wirings 131 extending in the column direction (Y-direction) and multiple row wirings 132 extending in the row direction (X-direction) are typically used as the wiring 13. In the matrix wiring, the column wirings 131 and the row wirings 132 intersect each other with an insulating layer (not illustrated) being provided therebetween. Here, it is illustrated that, at the intersection of one column wiring 131 and one row wiring 132, the column wiring 131, the insulating layer, and the row wiring 132 are stacked on the first substrate 1 in this order. That is, the column wiring 131 serves as a lower line, and the row wiring 132 serves as an upper line.

The drive circuit is a circuit for driving the electron-emitting devices 11, that is, for causing electrons to be emitted. The drive circuit is an electric circuit that at least includes the cathode-potential setting unit 22 and, if necessary, a gate-potential setting unit 23. As illustrated in FIG. 1C, one row wiring 132 connected to the cathode of one electron-emitting device 11 is connected to the cathode-potential setting unit 22 in the outer space and is set to a cathode potential Vc. One column wiring 131 connected to the gate of the electron-emitting device 11 is connected to the gate-potential setting unit 23 in the outer space and is set to a gate potential Vg. The gate potential Vg is higher than the cathode potential Vc. The electron-emitting device 11 emits electrons in accordance with a potential difference (drive voltage) Vd between Vc and Vg. The drive voltage Vd is typically 100 V or less. For example, a desired drive voltage Vd can be obtained by setting Vc to a negative potential and Vg to a positive potential with respect to the ground potential.

The face plate 200 at least includes a second substrate 2, which is an insulating substrate that is transparent, i.e., that has transparency to light, and an anode 8 provided on a surface 201 of the second substrate 2. The surface 201 of the second substrate 2 is the surface of the second substrate 2, facing the inner space 300.

The anode 8 is a conductive member that is shaped as a film, a layer, or a plate. For example, a metal thin film called "metal back" may be used to form the anode 8. Preferably, aluminum is used as a metal of the metal back. Alternatively, a transparent conductive material such as ITO or ZnO may be used as the anode 8.

The face plate 200 further includes light-emitting members 12, such as fluorescent materials or phosphors, on the surface 201 of the second substrate 2. When a metal back is used as the anode 8, the light-emitting members 12 are provided between the metal back and the second substrate 2. When a transparent conductive material is used as the anode 8, the anode 8 may be provided between the second substrate 2 and the light-emitting members 12. In either case, the anode 8 is provided on the surface 201 of the second substrate 2.

If necessary, the display panel 1000 includes a guard electrode 6 and a connection electrode 7 on the surface 201 of the second substrate 2.

As described above, the display panel 1000 has a structure in which the anode 8 and the light-emitting members 12 of the face plate 200 are disposed so as to face, at a distance, the electron-emitting devices 11 of the rear plate 100. With this structure, a display region can be formed. The display region is a region in which, on the face plate 200, the light-emitting members 12 are provided, and, on the rear plate 100, the electron-emitting devices 11 are provided. In other words, a region where the electron-emitting devices 11 face the light-emitting devices 12 is regarded as a display region.

An anode terminal 4 penetrates through the first substrate 1 and is electrically connected to the anode 8 in the inner space 300. The anode terminal 4 is connected to the anode-potential setting unit 20 in the outer space and is set to an anode potential Va. The anode potential Va is a potential that is higher than the cathode potential Vc and is higher than the gate potential Vg.

In the embodiment of the present invention, members are "electrically connected" when the members are mechanically connected to each other directly or via a conductive member and are thus electrically conductive. Members are "mechanically connected" when the members are adhered or joined to each other or abut on each other, or when the members are in contact with each other.

A portion surrounded by a one-dot chain ellipse in FIG. 1A will now be described in detail. The portion surrounded by the one-dot chain ellipse is provided outside the display region, and, as illustrated in FIG. 1A, is preferably provided near a corner of the display panel 1000.

The anode terminal 4 is typically a conductive member such as a metal pin or a metal spring. As illustrated in FIG. 1B, the anode terminal 4 exists over the outside (outer space) of the display panel 1000 and, via a lead-in 10 (portion surrounded by a two-dot chain ellipse) provided on the first substrate 1, the inside (inner space 300) of the display panel 1000. That is, the anode terminal 4 penetrates through the first substrate 1.

The anode 8 is electrically connected to the anode terminal 4 via the connection electrode 7. Here, the structure is illustrated in which the anode 8 is electrically connected to the connection electrode 7, and the connection electrode 7 is electrically connected to the anode terminal 4. However, the anode 8 and the anode terminal 4 may be directly and electrically connected to each other without providing the connection electrode 7 therebetween.

Specifically, at the lead-in 10, the anode terminal 4 goes through a through hole 10*a* provided in the first substrate 1. In this manner, the anode terminal 4 penetrates through the first substrate 1. At the lead-in 10, the through hole 10*a* is filled up using a sealing member 10*b* in order to maintain the inner space 300 of the display panel 1000 as a vacuum. Though not illustrated, an auxiliary member that helps connection of the anode terminal 4 to the connection electrode 7 or that helps fixing of the anode terminal 4 to the first substrate 1 may be provided near the lead-in 10. When the auxiliary member and the sealing member 10*b* are conductive and when these members are electrically connected to the anode terminal 4 illustrated in FIG. 1B and set to the anode potential Va, the anode terminal 4 including these conductive members may be regarded as an anode terminal.

The anode 8 is set to the anode potential Va or a potential that is substantially equal to the anode potential Va via the anode terminal 4 and the connection electrode 7. Electrons emitted from the electron-emitting devices 11 are accelerated by the anode potential Va and collide with the light-emitting members 12. As above, the display apparatus according to the embodiment of the present invention is an electron beam device that accelerates electrons emitted from the electron-emitting devices 11 using an electric field formed by the anode 8.

The light-emitting members 12 emit light as a result of collision of electrons. The practical anode potential Va necessary for causing the light-emitting members 12 to emit light is within the range from 1 kV to 100 kV, preferably within the range from 5 kV to 30 kV, and more preferably within the range from 10 kV to 25 kV.

As illustrated in FIG. 1B, a member that is conductive (conductive member 3) is provided on the surface 101 of the first substrate 1. Part of the conductive member 3 is positioned in a region between the wiring 13 and the anode terminal 4. Regarding the multiple column wirings 131, part of the conductive member 3 is positioned between the anode terminal 4 and one of the column wirings 131 that is closest to the anode terminal 4. In other words, the wiring 13 connected to the electron-emitting device 11 is not positioned between the conductive member 3 and the anode terminal 4. The conductive member 3 is provided at a distance from the wiring 13 and from the anode terminal 4 and is not electrically connected to the wiring 13 or the anode terminal 4.

In FIG. 1B, the shape of a cross section (X-Z face) of the conductive member 3 is trapezoid. However, the cross-sectional shape of the conductive member 3 is not particularly restricted, and may be rectangle or semi-ellipse.

For the conductive member 3, a material whose volume resistivity is $10^{-3}$ Ωm or less may be used, or a material whose volume resistivity is $10^{-5}$ Ωm or less may preferably be used. As a material suitable for the conductive member 3, a metal such as Cu, Ag, Au, Al, Ti, or Pt, or an alloy or a metallic compound including these metals may be used. As a method for forming the conductive member 3, the conductive member 3 may be formed by preparing a member that is shaped as the conductive member 3 beforehand and arranging this member on the surface 101 of the first substrate 1. However, the thickness of the conductive member 3 is preferably thin in order to suppress discharge between the conductive member 3 and at least one of the anode 8 and the connection electrode 7. Practically, the thickness of the conductive member 3 is 100 μm or less. Therefore, the conductive member 3 is preferably formed as a conductive film on the surface 101 of the first substrate 1 by using a known method, such as a vacuum film forming method, a printing method, or a metal plating method. In particular, in view of the convenience of fabrication, the conductive member 3 is preferably formed using the same material as that of the wiring 13 provided on the first substrate 1, in the same step as the step of forming the wiring 13.

FIG. 1C is an X-Y plan schematic view of the portion illustrated in FIG. 1B, seen from the face plate 200 side. The same members as those in FIGS. 1A and 1B are illustrated using common reference numerals.

In the embodiment of the present invention, the conductive member 3 is a loop-shaped member provided so as to surround the anode terminal 4. Therefore, the inner edge of the conductive member 3 can be specified. That is, the inner edge is the edge (contour) of the conductive member 3 facing the anode terminal 4 side. An ideal shape of the inner edge is geometrically described as a closed curve (loop). A closed curve includes, for example, a circle, an ellipse, and a polygon. Practically, the shape of the inner edge (rim) is preferably "circle". In the embodiment of the present invention, a "circle" is defined as a shape in which the ratio between the minimum and the maximum of a distance from the geometrical center of gravity to the inner edge is 0.92 or greater. When the inner edge has a portion that is sharply pointed toward the anode terminal 4 side, an electric field tends to be concentrated in that portion. Therefore, the inner edge is preferably smooth and even.

In FIG. 1C, lead-out portions 5, which are surrounded by dotted lines, are portions of the conductive member 3. The lead-out portions 5 extend from the inner edge toward the edge of the first substrate 1. A region 90 is a region where the frame member 9 illustrated in FIGS. 1A and 1B is positioned on the first substrate 1. As can be understood from the positional relationship between the region 90 and the lead-out portions 5, the lead-out portions 5 extend toward the edge of the first substrate 1, thereby an end of the lead-out portions 5 being extracted to the outer space. The outer edge of each of the lead-out portions 5 has a shape that relatively protrudes toward the edge of the first substrate 1, with respect to the overall outer edge of the conductive member 3. The outer edge of the conductive member 3 is the edge of the conductive member 3 that is opposite from the anode terminal 4, that is, the edge that is not the inner edge. The lead-out portions 5 may be formed by connecting a linear conductive member to the other conductive member that surrounds the anode terminal 4. However, the lead-out portions 5 are preferably formed as members unified with the other portion, in terms of the ease of forming the conductive member 3.

Since the end of each of the lead-out portions 5 is connected to the prescribed-potential setting unit 21 in the outer space, the conductive member 3 is set to a prescribed potential Vr. The prescribed potential Vr is lower than the anode potential Va. The prescribed potential Vr is preferably closer to the ground potential than to a potential applied to the electron-emitting device 11. The prescribed potential Vr is preferably the ground potential. Current flowing through the conductive member 3 flows into the prescribed-potential setting unit 21 via the lead-out portions 5, which will be described in detail later.

Although not illustrated in the drawings, apart from the lead-out portion 5, a protruding portion (protrusion) that extends toward the edge of the first substrate may be provided as part of the outer edge of the conductive member 3. Different from the lead-out portion 5, the protrusion is a portion that is not directly connected to a unit that defines the potential of the conductive member 3 (e.g., the prescribed-potential setting unit 21). The protrusion is indirectly connected to the prescribed-potential setting unit 21 via the lead-out portion 5. Current does not flow through such a protrusion as current flows through the lead-out portion 5. The protrusion simply has a function of defining a potential nearby to the prescribed potential Vr. For example, in FIG. 3A, when the prescribed-potential setting unit 21 is connected only to a portion represented by reference numeral 51, and when the prescribed-potential setting unit 21 is not connected to a portion represented by reference numeral 52, the portion represented by reference numeral 51 is a lead-out portion, and the portion represented by reference numeral 52 is a protrusion.

As described above, the anode terminal 4 is set to the anode potential Va, and the conductive member 3 is set to the potential Vr lower than the anode potential Va. Therefore, the conductive member 3 has a function that intercepts an electric field generated by the anode terminal 4 and reduces the effects of the electric field on members such as the electron-emitting device 11 and the wiring 13.

At the same time, an electric field in accordance with the potential difference between the anode potential Va and the prescribed potential Vr and in accordance with the spatial distance between the anode terminal 4 and the conductive member 3 is generated near the conductive member 3. More specifically, members other than the anode terminal 4, such as the connection electrode 7, the anode 8, and the wiring 13, affect the electric field near the conductive member 3; however, the effect of the anode terminal 4 is dominant.

When a strong electric field is generated near the conductive member 3, electrons may be emitted from the conductive member 3 as a result of the electric field. This may lead to discharge between the conductive member 3 and a member (the anode terminal 4, the connection electrode 7, or the anode 8) set to a potential (anode potential Va) higher than the prescribed potential. In particular, creeping discharge occurs easily between the conductive member 3 and the anode terminal 4.

As a result of the discharge, the conductive member 3 may be damaged. When the conductive member 3 is damaged, the interception effect may become weaker. As a result of the discharge, the wiring 13 may be damaged. When the wiring 13 is damaged, this may affect the driving of the electron-emitting device 11.

For example, discharge in the inner space 300 causes residual gas in the inner space 300 and gas discharged from the rear plate 100, the face plate 200, and the like to become plasma. When this plasma contacts the wiring 13, discharging current may flow into the wiring 13. When discharging current flows into the conductive member 3, induced current may flow into the wiring 13.

In general, when the electron-emitting device 11 is to be normally driven, that is, when electrons are to be emitted, current flowing through the wiring 13 or the electron-emitting device 11 and the drive circuit is expected to range from a few μA to a few mA. In contrast, current generated as a result of discharge may become a large current ranging from a few 100 mA to a few A. When current flows through the electron-emitting device 11 and the drive circuit due to the flow of current through the wiring 13 as a result of discharge, the electron-emitting device 11 and the drive circuit may be damaged depending on the magnitude of the current. Therefore, the flow of current through the wiring 13 as a result of discharge is not favorable. According to the embodiment of the present invention, effects of discharge on the wiring 13, the electron-emitting device 11, and the drive circuit can be reduced.

Figure 2A:
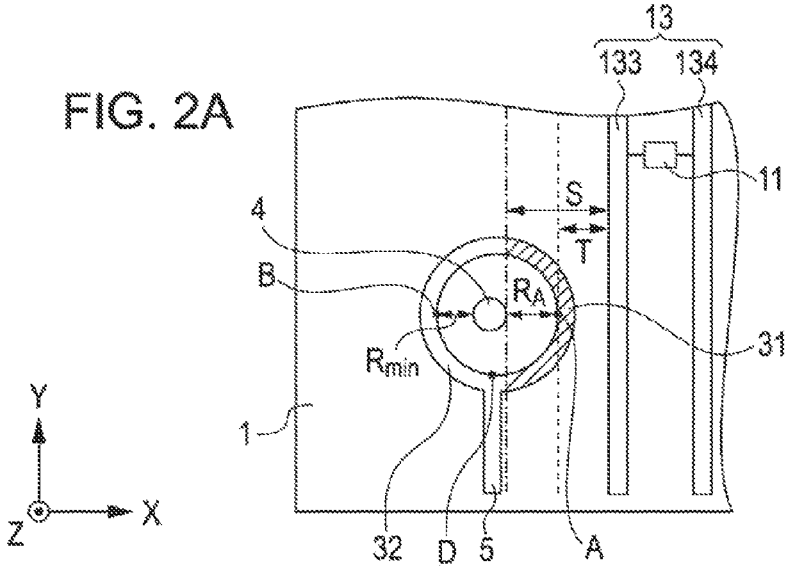
FIGS. 2A to 2C are schematic diagrams illustrating a display panel according to an embodiment of the present invention.
Figure 2B:
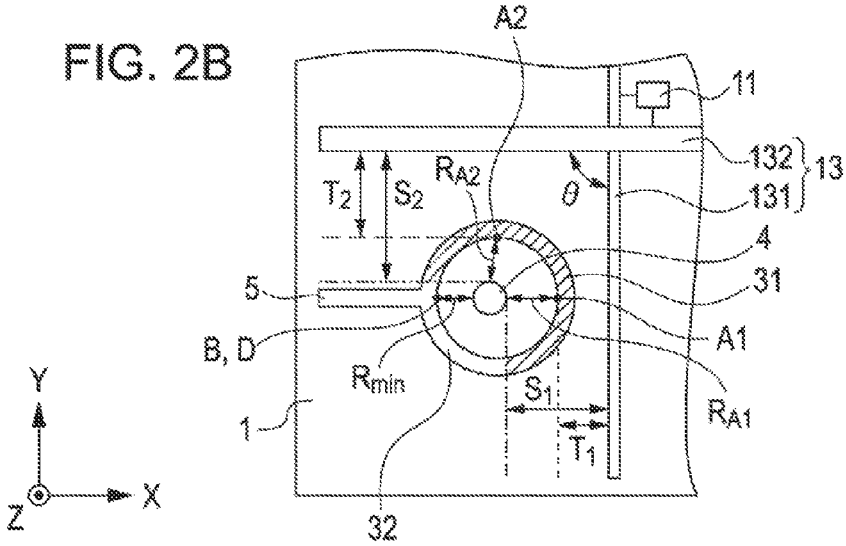
Figure 2C:
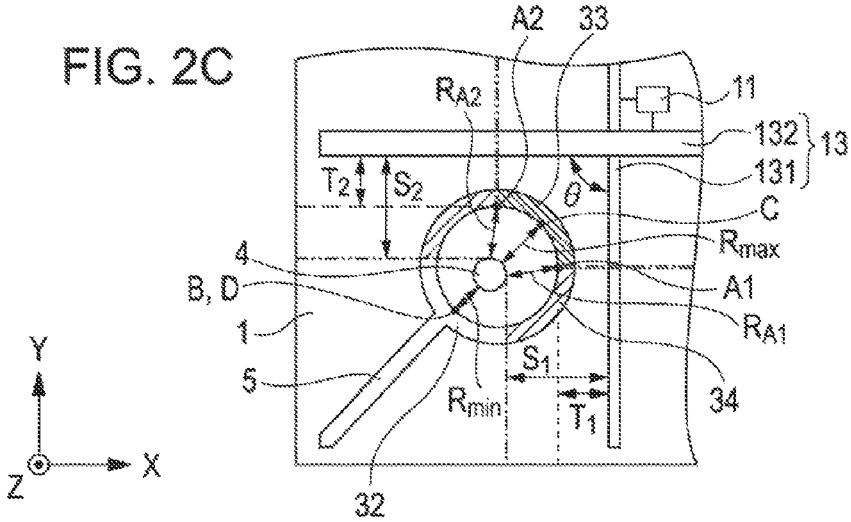
Figure 3A:
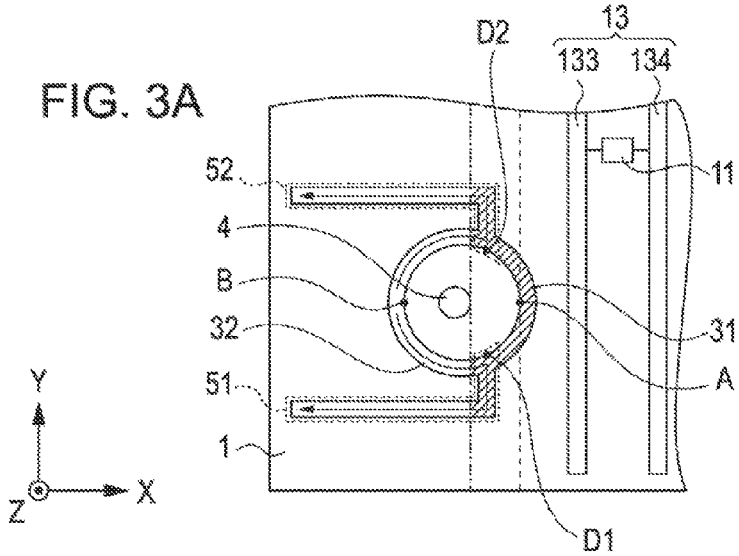
FIGS. 3A to 3C are schematic diagrams illustrating a display panel according to an embodiment of the present invention.
Figure 3B:
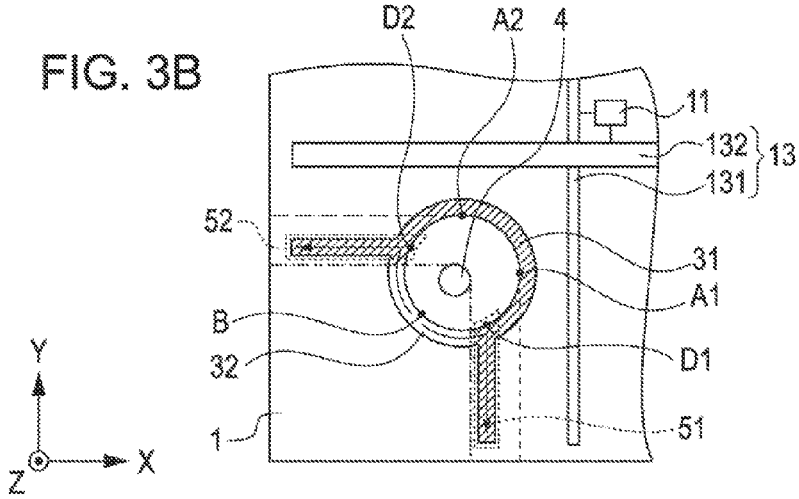
Figure 3C:
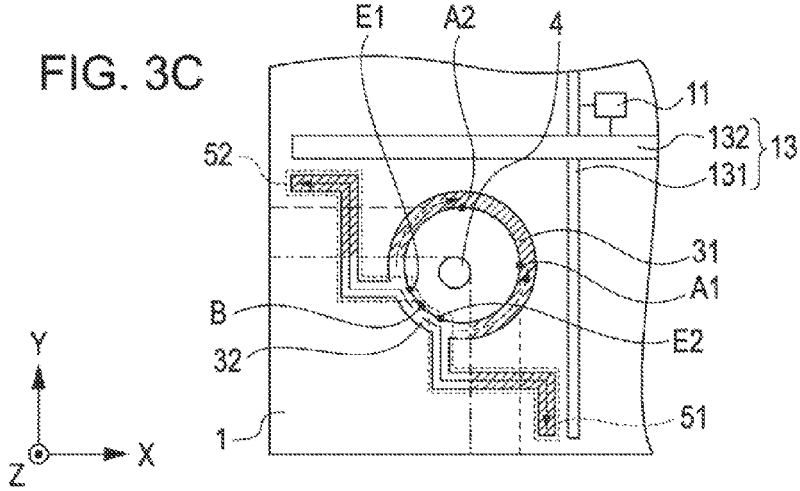

Features of the embodiment of the present invention will now be described using FIGS. 2A to 2C, 3A to 3C, 4A to 4C, 5A, 5B, and 6A to 6C including modifications of the configuration illustrated in FIG. 1C. In FIGS. 2A to 6C, the same members or members that have the same function are illustrated using a common reference numeral. In order to avoid complication of the figures, the conductive member 3 is illustrated by being separated into parts 31 and 32 or parts 32, 33, and 34 in FIGS. 2A to 3C, and 6A to 6C, and reference numeral 3 is omitted. Also in the following description, portions represented by reference numerals 5, 51, and 52 will all be described as lead-out portions that are directly connected to the prescribed-potential setting unit 21. In FIGS. 3A to 3C, the lead-out portion 5 is illustrated by being separated into lead-out portions 51 and 52, and reference numeral 5 is omitted.

In the present invention, the inner edge of the conductive member 3 is represented as a set of multiple (countless) points. The conductive member 3 of the embodiment of the present invention includes, at the inner edge thereof, multiple portions whose distances from the anode terminal 4 are different. In other words, each of the multiple portions is a portion including only one of the multiple points or a portion including a set of consecutive points that are equidistant from the anode terminal 4. FIGS. 2A to 2C illustrate configurations in which the inner edge of the conductive member 3 is circular, the outer edge of the anode terminal 4 is circular, and the center of the outer edge of the anode terminal 4 is not coincident with the center of the inner edge of the conductive member 3. As is clear from the figures, the anode terminal 4 is eccentric with the conductive member 3 in a direction deviating from the wiring 13. The "center" used here is, in more detail, the geometrical center of gravity of each of the outer edge and the inner edge defining the distance between the anode terminal 4 and the conductive member 3. In the configurations illustrated in FIGS. 2A to 2C, the distance between the inner edge of the conductive member 3 and the anode terminal 4 continuously changes. Therefore, each of the "multiple portions" may be one point, and the "multiple portions" may be regarded as numerous points.

The "distance" used here includes "a spatial distance and a creeping distance". That is, the multiple portions have different "linear distances" from the anode terminal 4, and different "creeping distances" from the anode terminal 4. A "spatial distance" is the minimum linear distance from any portion of the inner edge of the conductive member 3 to the anode terminal 4. A "creeping distance" is the minimum distance from any portion of the inner edge at the interface between the conductive member 3 and the first substrate 1 to the edge of the interface between the anode terminal 4 and an insulating member (the edge facing toward the conductive member 3), along the surface of the insulating member. The insulating member used here is typically the first substrate 1. When the sealing member 10*b* or the auxiliary member has an insulating property, or when an insulating depressed-protruding structure is provided on the surface of the first substrate 1, as described later, the insulating member is a path along the surface of these members.

In the embodiment of the present invention, "close to", "far from", and "at a distance" refer to positional relationships in relation to the spatial distance. In the configurations illustrated in FIGS. 2A to 4C, as illustrated in FIG. 1B, the insulating member (first substrate 1) positioned between the conductive member 3 and the anode terminal 4 is smooth. In this manner, if there is no factor, other than the difference in spatial distance, that gives rise to different creeping distances, when the spatial distances are different, the creeping distances are also different.

FIG. 2A illustrates a configuration of ladder-type wiring of the wiring 13 in which a first line 133 and a second line 134 do not intersect each other. A line that is adjacent to the conductive member 3 is only the first line 133, and the second line 134 is provided at a greater distance from the conductive member 3 than the first line 133 is.

In FIG. 2A, a part (hereinafter referred to as an "intermediate part 31") of the conductive member 3, which is positioned in a region (hereinafter referred to as an "intermediate region") between the wiring 13 and the anode terminal 4, is indicated by hatching. Here, the spatial distance between the anode terminal 4 and the first line 133 is S. In FIG. 2A, positions at which the spatial distance from the first line 133 is S are indicated by a one-dot chain line. As is understood from FIG. 2A, a region where the spatial distance from the first line 133 is less then S, with respect to the spatial distance S between the anode terminal 4 and the first line 133, that is, a region between the one-dot chain line and the first line 133, is the intermediate region.

Also in FIG. 2A, a part (hereinafter referred to as a "non-intermediate part 32") of the conductive member 3, which is positioned in a region (hereinafter referred to as a "non-intermediate region") outside the intermediate region, is indicated by not using hatching. As is understood from FIG. 2A, a region where the spatial distance from the first line 133 is S or greater, that is, a region at a greater distance from the first line 133 than the distance at the one-dot chain line, is the non-intermediate region.

Points A and B illustrated in FIG. 2A are indicated to represent two portions (the point A corresponds to a portion A and the point B corresponds to a portion B) among the multiple portions.

The portion A indicates, among the multiple portions, a portion closest to the first line 133. The distance between the first line 133 and the portion A is T. T is the minimum value of the spatial distance between the inner edge of the conductive member 3 and the first line 133. In FIG. 2A, positions at which the spatial distance from the first line 133 is T are indicated by a broken line. The portion A is positioned in the intermediate region and belongs to the inner edge of the intermediate part 31. The spatial distance between the portion A and the anode terminal 4 is $R_A$. In this configuration, $R_A$ is the maximum value of the spatial distance between the inner edge of the conductive member 3 and the anode terminal 4.

Therefore, among the multiple portions, portions other than the portion (portion A) closest to the first line 133 each have a distance from the anode terminal 4 that is shorter than $R_A$. Thus, among the multiple portions, discharge occurs more easily in portions (e.g., the portion B) other than the portion A, compared with the portion A. In contrast, discharge occurs less easily in the portion A, compared with the other portions. Since the portion A is the closest portion to the first line 133, effects of discharge on the first line 133 and the electron-emitting device 11 can be reduced by suppressing discharge in the portion A.

The portion B indicates a portion where, among the multiple portions, the distance from the anode terminal 4 is the shortest. The spatial distance between the portion B and the anode terminal 4 is Rmin. That is, Rmin is the minimum value of the spatial distance between the inner edge of the conductive member 3 and the anode terminal 4.

As is clear from FIG. 2A, the portion B is provided at a distance from the portion A. In the configuration illustrated in FIG. 2A, among the multiple portions, the portion B is positioned at the farthest from the first line 133. Since the portion B has the shortest distance from the anode terminal 4, discharge occurs most easily in the portion B. By providing the portion B at a position away from the portion A, effects of discharge that has occurred in the portion B on the first line 133 and the electron-emitting device 11 can be reduced.

In particular, the portion B is preferably positioned outside the intermediate region. That is, preferably the portion B is positioned in the non-intermediate region and belongs to the inner edge of the non-intermediate part 32. If the portion B is positioned in the intermediate region, current that has occurred as a result of discharge flows via the intermediate part 31. In contrast, when the portion B is positioned in the non-intermediate region, the probability of current that has occurred as a result of discharge flowing via the intermediate part 31, or the proportion of current flowing via the intermediate part 31 out of current that has occurred as a result of discharge, can be reduced.

FIG. 2B illustrates a configuration of matrix wiring of the wiring 13 in which the column wirings 131 and the row wirings 132 are provided so as to intersect each other. In FIG. 2B, one column wiring 131 and one row wiring 132 are adjacent to the conductive member 3. The column wiring 131 is provided closer to the conductive member 3 than the row wiring 132 is. The width of the column wiring 131 is narrower than that of the row wiring 132, and the cross section of the column wiring 131 is smaller than that of the row wiring 132. When the number of column wirings 131 is greater than the number of row wirings 132, as in this example, at least some or all of the column wirings 131 have a narrower width compared with the row wirings 132. For example, in a typical display panel for high-definition television (HDTV) standards, the number of column wirings 131 may be designed to be five times as many as the number of row wirings 132.

In FIGS. 2A and 2B, the conductive member 3 and the anode terminal 4 have the same positional relationship.

Also in FIG. 2B, as in FIG. 2A, a part (intermediate part 31) of the conductive member 3, which is positioned in a region (intermediate region) between the wiring 13 and the anode terminal 4, is indicated by hatching.

Here, the spatial distance between the anode terminal 4 and the column wiring 131 is $S_1$. In FIG. 2B, positions at which the spatial distance from the column wiring 131 is $S_1$ are indicated by a one-dot chain line. The spatial distance between the anode terminal 4 and the row wiring 132 is $S_2$. In FIG. 2B, positions at which the spatial distance from the row wiring 132 is $S_2$ are indicated by a two-dot chain line. As is understood from FIG. 2B, with respect to the spatial distance $S_1$ between the anode terminal 4 and the column wiring 131, a region where the spatial distance from the column wiring 131 is less than $S_1$, that is, a region between the column wiring 131 and the one-dot chain line, is an intermediate region. Also, with respect to the spatial distance $S_2$ between the anode terminal 4 and the row wiring 132, a region where the spatial distance from the row wiring 132 is less than $S_2$, that is, a region between the row wiring 132 and the two-dot chain line, is also an intermediate region. In other words, in this configuration, the intermediate region includes a region between the column wiring 131 and the anode terminal 4 and a region between the row wiring 132 and the anode terminal 4. As in FIG. 2A, a part (non-intermediate part 32) of the conductive member 3, which is positioned in a region (non-intermediate region) outside the intermediate region, is indicated by not using hatching. The non-intermediate region is a region that is not between the column wiring 131 and the anode terminal 4 and that is not between the row wiring 132 and the anode terminal 4.

Points A1, A2, and B illustrated in FIG. 2B are indicated to represent, among the multiple portions, three portions A1, A2, and B, respectively.

Among the multiple portions, the portions A1 and A2 are portions that are closest to the wiring 13. More specifically, the portion A1 is a portion that is closest to the column wiring 131, and the portion A2 is a portion that is closest to the row wiring 132. The distance between the column wiring 131 and the portion A1 is $T_1$. $T_1$ is the minimum value of the spatial distance between the inner edge of the conductive member 3 and the column wiring 131. In FIG. 2B, positions at which the spatial distance from the column wiring 131 is $T_1$ are indicated by a short-broken line. The portion A1 belongs to the inner edge of the intermediate part 31. The distance between the portion A1 and the anode terminal 4 is $R_{A1}$. In this configuration, $R_{A1}$ is the maximum value of the spatial distance between the inner edge of the conductive member 3 and the anode terminal 4. The distance between the row wiring 132 and the portion A2 is $T_2$. $T_2$ is the minimum value of the spatial distance between the inner edge of the conductive member 3 and the row wiring 132. In FIG. 2B, positions at which the spatial distance from the row wiring 132 is $T_2$ are indicated by a long-broken line. The spatial distance between the portion A2 and the anode terminal 4 is $R_{A2}$. $R_{A2}$ is shorter than $R_{A1}$.

The portion B is, among the multiple portions, a portion whose distance from the anode terminal 4 is the shortest, as in the portion B described in the configuration illustrated in FIG. 2A.

Among the multiple portions, portions (e.g., the portion A2 and the portion B) other than the portion A1 have shorter distances from the anode terminal 4, compared with the portion A1. Thus, discharge occurs more easily in these portions than in the portion A1. In contrast, discharge occurs less easily in the portion A1 than in the other portions. Since the portion A1 is a portion that is closest to the column wiring 131, effects of discharge on the column wiring 131 and the electron-emitting device 11 can be reduced by suppressing discharge in the portion A1.

The column wiring 131 that is most adjacent to the portion A1 is thinner than the row wiring 132, and the column wiring 131 breaks easily. Since the spatial distance ($T_1$) between the portion A1 and the column wiring 131 is shorter than the spatial distance ($T_2$) between the portion A2 and the row wiring 132, it is more likely that discharge affects the column wiring 131. As in this configuration, when $R_{A1}$ is longer than $R_{A2}$, effects of discharge on the column wiring 131 can be reduced more preferentially to effects of discharge on the row wiring 132.

FIG. 2C also illustrates a configuration of matrix wiring in which the column wiring 131 and the row wiring 132 are provided so as to intersect each other. The column wiring 131 and the row wiring 132 are adjacent to the conductive member 3.

The spatial distance between the anode terminal 4 and the column wiring 131 is $S_1$. In FIG. 2C, positions at which the spatial distance from the column wiring 131 is $S_i$ are indicated by a one-dot chain line. The spatial distance between the anode terminal 4 and the row wiring 132 is $S_2$. In FIG. 2C, positions at which the spatial distance from the row wiring 132 is $S_2$ are indicated by a two-dot chain line. Here, $S_1$ and $S_2$ are the same value. However, as in the configuration illustrated in FIG. 2B, $S_1$ and $S_2$ may be different values.

A part 33 indicated by pale hatching and a part 34 indicated by dark hatching in FIG. 2C are intermediate parts positioned in a region (intermediate region) between the wiring 13 and the anode terminal 4.

More specifically, the intermediate region includes, as in the configuration illustrated in FIG. 2B, a region between the column wiring 131 and the anode terminal 4 and a region between the row wiring 132 and the anode terminal 4. A part 32 of the conductive member 3 that is indicated by not using hatching is a non-intermediate part 32 that is a part positioned in a region (non-intermediate region) outside the intermediate region.

Points A1, A2, and B illustrated in FIG. 2C are indicated to represent, among the multiple portions, three portions A1, A2, and B, as in FIG. 2B. Although $R_{A1}$ and $R_{A2}$ are the same value in this configuration, $R_{A1}$ and $R_{A2}$ may be different values.

The intermediate region can be divided into a first intermediate region and a second intermediate region. A part of the conductive member 3 that is positioned in the first intermediate region is the first intermediate part 33 indicated by dark hatching in FIG. 2C. A part of the conductive member 3 that is positioned in the second intermediate region is the second intermediate part 34 indicated by pale hatching in FIG. 2C.

The first intermediate region is a region in which the spatial distance from the row wiring 132 is less than or equal to the spatial distance between the portion A1 and the row wiring 132, and the spatial distance from the column wiring 131 is less than or equal to the spatial distance between the portion A2 and the column wiring 131. In FIG. 2C, positions at which the spatial distance from the row wiring 132 is the same as the spatial distance between the portion A1 and the row wiring 132 are indicated by a doublet one-dot chain line. Also, positions at which the spatial distance from the column wiring 131 is the same as the spatial distance between the portion A2 and the column wiring 131 are indicated by a doublet two-dot chain line.

Therefore, the inner edge of the first intermediate part 33 includes, of two paths connecting the portions A1 and A2 along the inner edge, one path that is closer to the column wiring 131 or the row wiring 132. Geometrically describing using FIG. 2C, the first intermediate part 33 includes, of two arcs (major arc and minor arc) connecting the points A1 and A2 along the inner periphery, one arc (minor arc) that is closer to the wiring 13. The second intermediate region is, within the intermediate region, a region outside the first intermediate region.

Among the multiple portions, a portion that belongs to the second intermediate part 34 and a portion (e.g., the portion B) that belongs to the non-intermediate part 32 each have a shorter distance from the anode terminal 4, compared with the portions A1 and A2. Therefore, discharge occurs less easily in the portions A1 and A2 than in the portion B. Therefore, effects of discharge on both the column wiring 131 and the row wiring 132 can be reduced. Thus, effects on the electron-emitting device 11 can be further reduced.

In this configuration, the portion B is preferably positioned on, of two paths connecting the portions A1 and A2 along the inner edge, one path that is farther from the column wiring 131 or the row wiring 132. That is, the portion B is preferably provided in the second intermediate part 34 or the non-intermediate part 32. When the portion B belongs to the second intermediate part 34 that is a part positioned in a region outside the first intermediate region or the non-intermediate part 32, the probability of current that has occurred in the portion B flowing via the portion A1 or A2 can be reduced. In contrast, when the portion B is provided in the first intermediate part 33, current that has occurred as a result of discharge flows via at least one of the portions A1 and A2. Therefore, the portion B is preferably positioned in a region outside the intermediate region (the first intermediate region and the second intermediate region), that is, more preferably, the portion B belongs to the non-intermediate part 32.

A point C illustrated in FIG. 2C indicates a portion C among the multiple portions. The portion C indicates, among the multiple portions, a portion whose distance from the anode terminal 4 is the longest. The spatial distance between the portion C and the anode terminal 4 is Rmax. Rmax is the maximum value of the spatial distance between the inner edge of the conductive member 3 and the anode terminal 4.

In this configuration, the distance from the anode terminal 4 becomes longer as a portion approaches from the portion A1 or A2 to the portion C. In this manner, a portion that is positioned closer to the row wiring 132 than the portion A1 is and that is positioned closer to the column wiring 131 than the portion A2 is preferably has a longer distance from the anode terminal 4 than the portions A1 and A2. That is, a portion whose distance from the anode terminal 4 is shorter than the portions A1 and A2 is not preferably provided in the first intermediate part 33. A portion (portion C) whose distance from the anode terminal 4 is the longest is preferably provided in the first intermediate region. Accordingly, the probability of current that has occurred as a result of discharge flowing via the portion A1 and/or A2 can be reduced.

In the configurations described so far, practically the spatial distance Rmin between the anode terminal 4 and the portion B is preferably 500 μm or greater. Also, the spatial distance between the anode terminal 4 and the portion A (A1 or A2) is preferably 1.2 times as great as Rmin or greater, and more preferably 1.5 times as great as Rmin or greater.

The length of the inner edge of the first intermediate part 33 is preferably as short as possible, and the length of the inner edge of the first intermediate part 33 is preferably shorter than ¼ of the entire length (perimeter) of the inner edge. The length of the inner edge of the first intermediate part 33 is the length of, of two paths connecting the points A1 and A2 along the inner edge, one path that is closer to the wiring 13 (the column wiring 131 and the row wiring 132). If discharge occurs in the first intermediate part 33, current that is generated as a result of the discharge flows through the point A and/or the point B. The possibility of the occurrence of discharge in the first intermediate part 33 can be further reduced by reducing the length of the inner edge of the first intermediate part 33. When the inner edge of the conductive member 3 is circular, the length of the inner edge of the first intermediate part 33 can be made shorter than ¼ of the entire length of the inner edge by increasing the angle θ formed by the column wiring 131 and the row wiring 132 to be greater than 90°. The length of the inner edge of the first intermediate part 33 can be made shorter by appropriately designing the shape of the wiring 13 and/or the shape of the conductive member 3. The foregoing angle θ is the smaller one of two angles (θ and 360°−θ) formed by column wiring 13 that faces the conductive member 3 and that is closest to the conductive member 3 and row wiring 132 that faces the conductive member 3 and that is closest to the conductive member 3, and the foregoing angle θ does not exceed 180°. In FIGS. 2B, 2C, 3B, and 3C, the angle θ is 90°, and the length of the inner edge of the first intermediate part 33 is ¼ of the entire length of the inner edge. In contrast, in FIGS. 6B and 6C described later, the angle θ is 120°, and the length of the inner edge of the first intermediate part 33 is ⅙ of the entire length of the inner edge.

According to the configurations described above, occurrence of discharge in the portions of the conductive member 3 closer to the wiring 13 can be suppressed, and effects on the wiring 13 and the electron-emitting device 11 can be reduced. Specifically, occurrence of discharge the immediate part 31 can be suppressed. The conductive member 3 including a portion (e.g., the portion B) whose distance from the anode terminal 4 is shorter than portions (portions A, A1, and A2) closest to the wiring 13 can effectively control occurrence of discharge.

Next, exemplary preferred configurations of the position of the lead-out portion 5 will be described using FIGS. 2A to 2C and FIGS. 3A to 3C. The position and the number of lead-out portions 5 are different in FIGS. 3A and 2A, and in FIGS. 3B and 2C. The positional relationship among the wiring 13, the inner edge of the conductive member 3, and the anode terminal 4 is the same in these figures. In FIG. 3C, the position where the lead-out portion 5 extends is different from that in FIG. 3B. FIG. 3C is a diagram for comparison with the other configurations.

The lead-out portion 5 preferably extends at a greater distance from the wiring 13 than the portions (portions A, A1, and A2) that are closest to the wiring 13 are. That is, as shown in FIG. 2A, the spatial distance between the lead-out portion 5 and the first line 133 is preferably greater than the spatial distance T between the first line 133 and the portion A. As shown in FIG. 2B, the spatial distance between the lead-out portion 5 and the column wiring 131 is preferably greater than the spatial distance $T_1$ between the column wiring 131 and the portion A1. Also in FIG. 2C, the spatial distance between the lead-out portion 5 and the column wiring 131 is greater than the spatial distance $T_1$ between the column wiring 131 and the portion A1, and the spatial distance between the lead-out portion 5 and the row wiring 132 is greater than the spatial distance $T_2$ between the row wiring 132 and the portion A2. In FIGS. 2A, 2B, and 2C, positions of T, $T_1$, and $T_2$ are indicated by a broken line, a short-broken line, and a long-broken line, respectively. The lead-out portion 5 extends at a greater distance from the wiring 13 than the distances at the broken line, the short-broken line, and the long-broken line. Lead-out portions 51 and 52 illustrated in FIG. 3A, which corresponds to FIG. 2A, are at a greater distance from the first line 133 than the distance at the broken line, which indicates the distance T. The lead-out portions 51 and 52 illustrated in FIG. 3B, which corresponds to FIG. 2B, are at a greater distance from the column wiring 131 than the distance at the short-broken line, which indicates the distance $T_1$, and at a greater distance from the row wiring 132 than the distance at the long-broken line, which indicates the distance $T_2$. In other words, the lead-out portion 5 is not positioned between the broken lines (short-broken line and long-broken line) and the wiring 13, and the lead-out portion 5 is positioned only in a region at a greater distance from the wiring 13 than the broken lines (short-broken line and long-broken line) are in the illustrated range.

In contrast, in the configuration illustrated in FIG. 3C, the lead-out portion 51 is closer to the column wiring 131 than the portion A1 is, and the lead-out portion 52 is closer to the row wiring 132 than the portion A2 is. That is, the lead-out portion 51 extends between the short-broken line and the column wiring 131, and the lead-out portion 52 extends between the long-broken line and the row wiring 132. In such a case, current flowing through the lead-out portion 51 may affect the column wiring 131, and current flowing through the lead-out portion 52 may affect the row wiring 132. These effects include induced current flowing through the wiring 13 as a result of current flowing through the lead-out portion 5 (51 and 52).

Figure 6A:
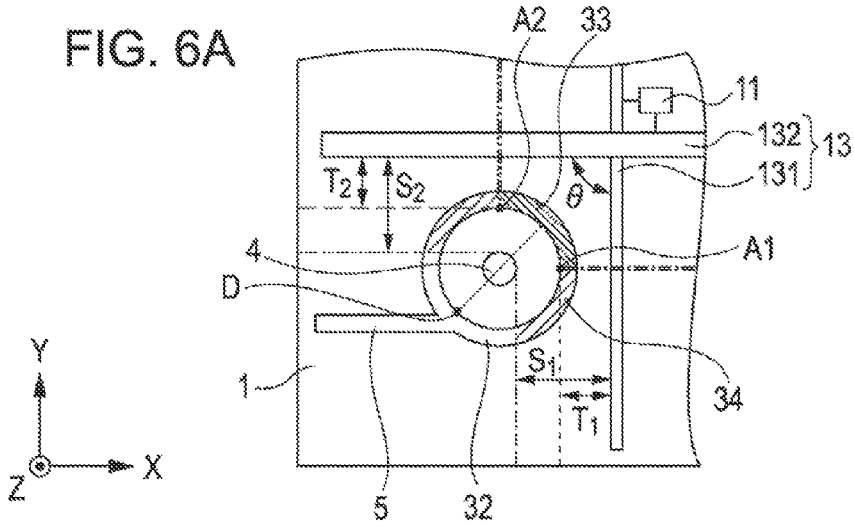
FIGS. 6A to 6C are schematic diagrams illustrating a display panel according to an embodiment of the present invention.
Figure 6B:
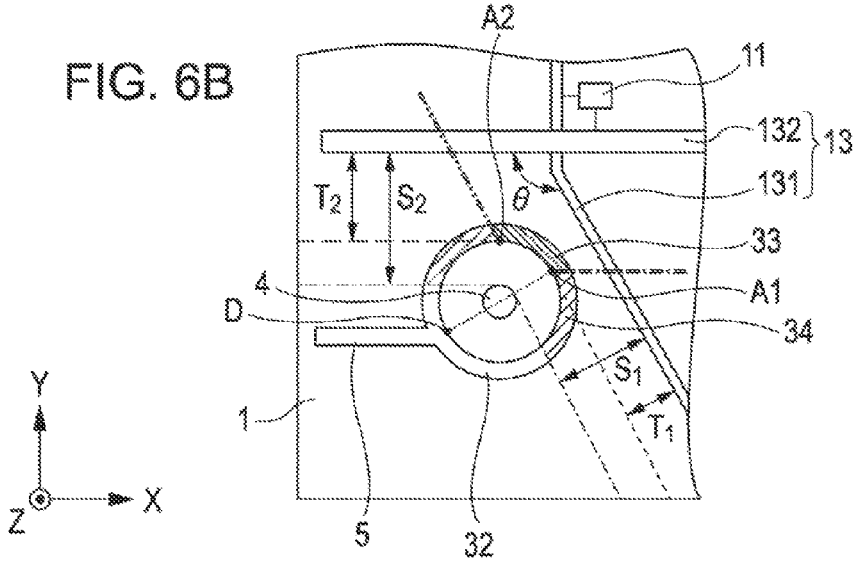
Figure 6C:
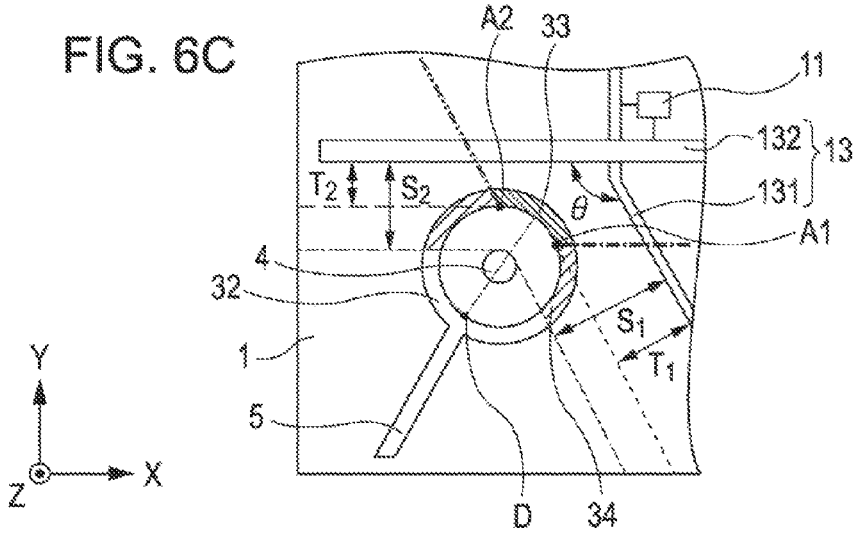

The embodiments in which the inner edge of the conductive member 3 has multiple portions whose distances from the anode terminal 4 are different have been described so far. However, the phenomenon in which current that is induced by current flowing through the lead-out portion 5 flows through the wiring 13 occurs, regardless of the positional relationship between the conductive member 3 and the anode terminal 4. For example, this phenomenon occurs when the distances ($R_A$) between portions (portions A, A1, and A2), among the multiple portions, that are closest to the wiring 13 and the anode terminal 4 are the shortest ($R_A$, $R_{A1}$, and/or $R_{A2}$=Rmin). Alternatively, this phenomenon occurs when the distance between the inner edge of the conductive member 3 and the anode terminal 4 is constant, that is, when all of the multiple (countless) points of the conductive member 3 are equidistant from the anode terminal 4, as shown in FIGS. 6A, 6B, and 6C. In such a case, as shown in FIGS. 6A, 6B, and 6C, the portions (portions A, A1, and A2) that are closest to the wiring 13, which have been used in the description, can be replaced by points (points A, A1, and A2) that are closest to the wiring 13. Although the point at which the distance between the conductive member 3 and the anode terminal 4 is the shortest (i.e. portion B) and the distance is the longest (i.e. portion C) cannot be defined, the intermediate region, and the intermediate part 31 (and the first intermediate part 33 and the second intermediate part 34) can be defined in FIGS. 6A to 6C, as in FIGS. 2A to 2C and 3A to 3C.

The induced current can be further reduced as the current path becomes more distant from the wiring 13 (the column wiring 131 and the row wiring 132). Therefore, by providing the lead-out portion 5 (51 and 52) at a greater distance from the wiring 13 (the column wiring 131 and the row wiring 132) than the point (or portion) A (A1 and A2) is, effects of current flowing through the lead-out portion 5 (51 and 52) on the wiring 13 can be reduced.

Also, the induced current can be further reduced when the angle formed by the lead-out portion 5 and the wiring 13 (the column wiring 131 and the row wiring 132) is not in parallel, as illustrated in FIGS. 2B, 2C, 6A, 6B, and 6C, than when the angle is parallel (0°), as illustrated in FIG. 2A. The angle formed by the lead-out portion 5 and the wiring 13 is preferably greater than 45°, and the angle becomes more preferable as the angle becomes closer to perpendicular (90°). The lead-out portion 5 (51, 52) is preferably not in parallel with at least one of the column wiring 131 and the row wiring 132, and the lead-out portion 5 (51, 52) is more preferably not in parallel with at least the column wiring 131, as in FIGS. 2B, 2C, 6A, 6B, and 6C. As in FIGS. 2C and 6C, the lead-out portion 5 is also preferably not in parallel with both of the column wiring 131 and the row wiring 132. In FIGS. 2B, 6A, and 6B, the lead-out portion 5 is parallel with the row wiring 132 and is perpendicular relative to the column wiring 131. Therefore, even when current flows through the lead-out portion 5 as a result of discharge, induced current rarely flows through the column wiring 131. One of the reasons that the lead-out portion 5 is preferably not in parallel with at least the column wiring 131 is that, as described above, at least part of the column wiring 131 has a smaller cross section than the row wiring 132, and the column wiring 131 is easier to break. Also, as described later, the fact that the frequency of a signal input to the column wiring 131 is typically high and noise (induced current) has a great effect on such a signal is another one of the reasons. In FIG. 2C, the lead-out portion 5 is not in parallel with the column wiring 131 and the row wiring 132. Further, as in FIG. 6C, having the angle θ to be greater than 90° makes it possible to allow both of the angle formed by the lead-out portion 5 and the column wiring 131, and the angle formed by the lead-out portion 5 and the row wiring 132 to be greater than 45°.

The lead-out portion 5 extends from a point D (portion D) on the inner edge. The point D is a point that belongs to the inner edge of a part different from the first intermediate part 33. In FIGS. 2B and 2C, the lead-out portion 5 extends from the portion B, and the portion D and the portion B coincide with each other. As described above, the portion B is a portion where, among the multiple portions of the inner edge, discharge occurs most likely. By allowing the portion D to coincide with the portion B, all or a large part of discharge current that has occurred in the portion B can be allowed to flow through the lead-out portion 5, and the discharge current can be suppressed from flowing into the intermediate part 31. As shown in FIGS. 2C, 6A, and 6C, when $T_1 \geqq T_2$, the length of a path from the point D along the inner edge to the point A1 without going through the point A2 and the length of a path from the point D along the inner edge to the point A2 without going through the point A1 are preferably equal. As shown in FIGS. 2B and 6B, when $T_2 > T_1$, the length of a path from the point D along the inner edge to the point A1 without going through the point A2 is preferably longer than the length of a path from the point D along the inner edge to the point A2 without going through the point A1. In FIGS. 2B and 6B, the distance between the point D and the point A1 along the inner edge is half the entire length of the inner edge. The ratio of the distances of the foregoing paths serves as a key factor in determining, when current is generated at any point as a result of discharge, the ratio of the magnitude of the current flowing through a counterclockwise path and the magnitude of the current flowing in a clockwise path on Figs. That is, a smaller amount of current flows through the longer one of the two paths, based on the ratio of resistances of the paths due to the conductive member 3. Therefore, when discharge occurs at an intermediate point of the inner edge of the first intermediate part 33, current that flows through the point A1 can be allowed to be half the discharge current or smaller.

It is preferable to provide a point on the inner edge side of the lead-out portion 5 (e.g. point D) at a position with a greater distance from the wiring 13 than a point which is closest to the wiring 13 among multiple points of the inner edge at which tangents relative to the inner edge define 45° to the wirings 13. The multiple points whose angle of tangent is defined 45° is defined to the column wiring 131, the row wiring 132, the first line 133 respectively. As in FIGS. 2A to 2C, 3A to 3C, and 6A to 6C, when the inner edge is circular, there are four points at which tangents define 45° relative to the column wiring 131. A straight line (not shown) connecting two points that are closer to the column wiring 131 than other two points among the four points can be assumed. The point on the inner edge side of the lead-out portion 5 is positioned further from the column wiring 131 than the assumed straight line. The same applies to the row wiring 132 and the first line 133. The angle formed by the tangent at the point A1 and the column wiring 131 and the angle formed by the tangent at the point A2 and the row wiring 132 are 0°. In this way, the point on the inner edge side of the lead-out portion 5 (e.g. point D) is positioned at a greater distance than such the point whose an angle of tangent relative to the inner edge is defined to the wiring 13 as becoming 45°, for the first time, in two paths along the inner edge from a point (as start point) that is closest to the wiring 13 among the inner edge (e.g. point A1, A2). The two paths are a clockwise path and a counterclockwise path. Therefore, the proportion of a discharge current flow whose direction becomes 45° or less relative to the wiring 13 at a position closer to the wiring 13 can be suppressed. As a result, the induced current flowing through the wiring 13 can be suppressed. In the embodiments in FIGS. 1A to 6C excluding FIG. 4B, points (D, D1, D2, E1, and E2) on the inner edge side of the lead-out portions 5, 51, and 52 are provided at such positions.

As described so far, the induced current can be suppressed by appropriately setting the angle formed by the lead-out portion 5 and the wiring 13 or the angle formed by the tangent at the point on the inner edge side of the lead-out portion 5 and the wiring 13. This is because the magnitude of a vector component in a direction in which, of a magnetic field generated by discharge current flowing through each point of the conductive member 3, an induced electromotive force is generated in the wiring 13 is proportional to the cosine function of the foregoing angle. That is, when the foregoing angle becomes 90°, the magnitude of a vector component in a direction in which an induced electromotive force is generated in the wiring 13 becomes minimum since) cos(90°)=0. When the foregoing angle becomes 0°, the magnitude of the same vector becomes maximum since) cos(0°)=1. When the foregoing angle is greater than 45° and less than or equal to 90°, the extent of a change (represented by the sine function, which is the derivative of the cosine function) in the magnitude of a vector component in a direction in which an induced electromotive force is generated in the wiring 13 becomes significantly small, compared with the case where the foregoing angle is greater than or equal to 0° and less than or equal to 45°.

As illustrated in FIGS. 3A to 3C, when multiple lead-out portions (lead-out portions 51 and 52) are provided, discharge current that flows through each of the lead-out portions can be reduced, compared with the case where there is only one lead-out portion. Even when multiple lead-out portions are provided, as described above, the distances between the lead-out portions 51 and 52 and the wiring 13 and the angles formed by the lead-out portions 51 and 52 and the wiring 13 can be preferably set. In the embodiments where the inner edge of the conductive member 3 has multiple portions whose distances from the anode terminal 4 are different, preferred embodiments of the positions of the multiple lead-out portions, particularly the positions, on the inner edge side, of the lead-out portions, will now be described. As illustrated in FIGS. 3A to 3C, the lead-out portion 5 preferably extends from at least two portions, namely, a portion D1 and a portion D2, or a portion E1 and a portion E2, among the multiple portions. In FIGS. 3A to 3C, two lead-out portions 51, 52 extending from two portions are indicated as the lead-out portions 51 and 52. Alternatively, three or more lead-out portions may be provided. Lead-out portions extending from two portions may join each other on the route to the edge of the first substrate 1.

In the configuration illustrated in FIG. 3A, the lead-out portion 51 extends from the portion D1 positioned on one path (path from the portion B in the counterclockwise direction in the figure) of two paths connecting, among the multiple portions, the portion B and the portion A along the inner edge. The lead-out portion 52 extends from the portion D2 positioned on the other path (path from the portion B in the clockwise direction in the figure) of the two paths connecting, among the multiple portions, the portion B and the portion A along the inner edge. Here, the phrase "positioned on (the path)" means that the portion D1 and the portion D2 are portions different from the portion A and the portion B.

In the configuration illustrated in FIG. 3B, the lead-out portion 51 extends from the portion D1 positioned on one path that does not include the portion A2 (path from the portion B in the counterclockwise direction in the figure) of two paths connecting the portion B and the portion A1 along the inner edge. The lead-out portion 52 extends from the portion D2 positioned on one path that does not include the portion A1 (path from the portion B in the clockwise direction in the figure) of the two paths connecting the portion B and the portion A2 along the inner edge.

As described above, the portion B is a portion where discharge occurs most easily among the multiple portions of the inner edge. Current generated as a result of discharge flows from the portion B through a clockwise path or a counterclockwise path in the figure, or flows through both these paths. Therefore, when there is only one lead-out portion, current may flow via a portion closest to the wiring 13. For example, when there is only the lead-out portion 51 in FIG. 3A, if current flows through a clockwise path, the current flows via the portion A. When there is only the lead-out portion 51 in FIG. 3B, if current flows through a clockwise path, the current flows via the portion A2 and the portion A1.

In contrast, when the lead-out portions 51 and 52 extend from the portions D1 and D2, respectively, it is highly likely that current generated in the portion B flows through the lead-out portion 51 and/or the lead-out portion 52, and does not flow via the portion A (the portion A1 and the portion A2). The path of current in the case where discharge occurs in the portion B as a result of the foregoing is indicated by solid arrows in FIGS. 3A and 3B. Thus, even when current flows through either a clockwise path or a counterclockwise path, current flowing through the portion A (the portions A1 and A2) can be reduced, or the probability of current flowing through the portion A (the portions A1 and A2) can be reduced.

In the configuration illustrated in FIG. 3C, the lead-out portions 51 and 52 extend from the portions E1 and E2, respectively, which are closer to the portion B than in the configuration illustrated in FIG. 3B. The portions E1 and E2 are positioned in the non-intermediate region and belong to the non-intermediate part 32. If discharge occurs in a portion at a greater distance from the portion B than the portions E1 and E2 are, current generated as a result of the discharge may flow via the portions A1 and A2, as indicated by broken arrows in FIG. 3C.

Therefore, when the portion B is provided in the non-intermediate part 32, as illustrated in FIGS. 3A and 3B, the lead-out portions 51 and 52 preferably extend from the portions D1 and D2 positioned in the intermediate region. Accordingly, the probability of current flowing through the portions A1 and A2 or the magnitude of current flowing through the portions A1 and A2 can be more reliably reduced. If the non-intermediate part 32 breaks, current can be reliably caused to flow through the lead-out portions 51 and 52. When the lead-out portions 51 and 52 at least include the portions D1 and D2 belonging to the intermediate part 31, the lead-out portions 51 and 52 may include the portions E1 and E2 belonging to the non-intermediate part 32.

As in the foregoing embodiments, the ratio of the distance of a path along the inner edge from a portion where discharge occurs (typically the portion B) to the portion D1 and the distance of a path along the inner edge from a portion where discharge occurs to the portion D2 serves as a key factor in the ratio of the magnitude of current in a clockwise path and the magnitude of current in a counterclockwise path from a portion where discharge occurs.

The configurations have been described so far in which the inner edge (rim) of the conductive member 3 is circular, the outer edge (surface) of the anode terminal 4 is circular, and the center of the outer edge of the anode terminal 4 is shifted from the center of the inner edge of the conductive member 3 in a direction deviating from the wiring 13. In this case, as described above, the multiple portions are typically numerous points.

Figure 4A:
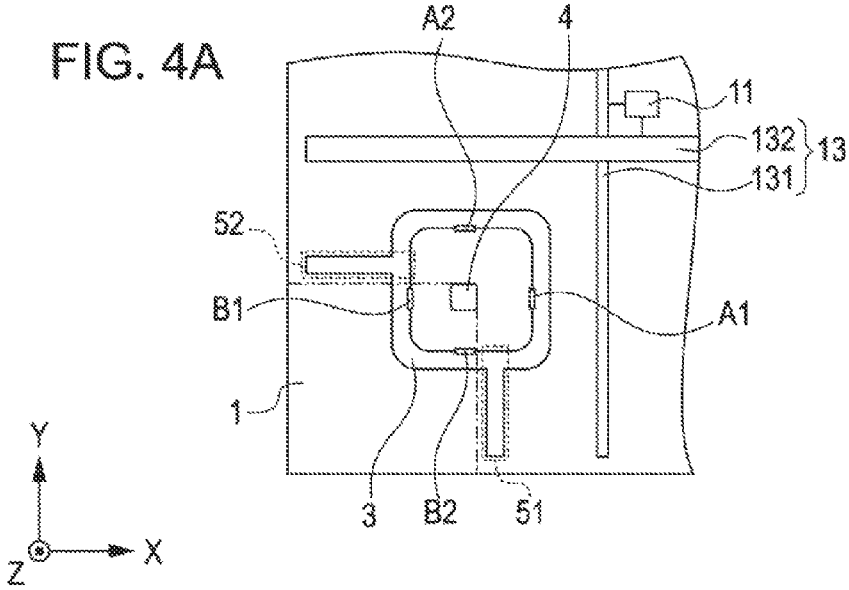
FIGS. 4A to 4C are schematic diagrams illustrating a display panel according to an embodiment of the present invention.

In a configuration illustrated in FIG. 4A, the inner edge of the conductive member 3 and the outer edge of the anode terminal 4 have linear portions. In such a case, a portion A1 closest to the column wiring 131 and a portion A2 closest to the row wiring 132 are not points; these portions A1 and A2 may be portions that have a certain length (width).

Figure 4B:
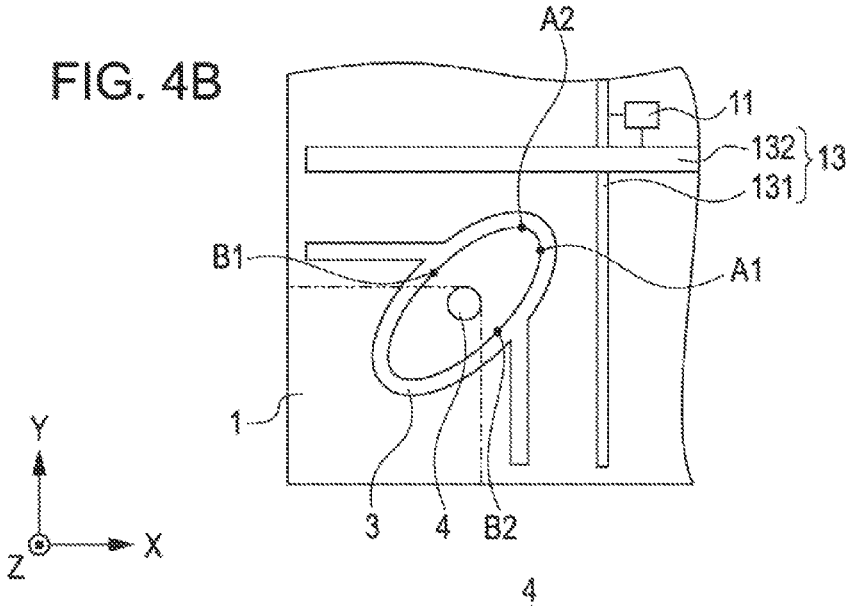

In a configuration illustrated in FIG. 4B, the inner edge of the conductive member 3 is elliptical, and the outer edge of the anode terminal 4 is circular. Also, the center of the inner edge of the conductive member 3 and the center of the outer edge of the anode terminal 4 are coincident with each other. In this manner, the shape of the inner edge of the conductive member 3 and the shape of the outer edge of the anode terminal 4 may be dissimilar shapes. The length of the inner edge of a first non-intermediate part (not shown) is clearly shorter than the entire length of the inner edge and is less than ¼ of the entire length of the inner edge. However, in this configuration, portions B1 and B2 are positioned in the intermediate region. As described about, the portions B1 and B2 are preferably positioned outside the intermediate region, and, as in the other configurations, the center of the outer edge of the anode terminal 4 is preferably not coincident with the center of the inner edge of the conductive member 3.

In the configurations illustrated in FIGS. 4A and 4B, the portions B1 and B2 are portions whose distances from the anode terminal 4 are the shortest. In this manner, among the multiple portions, there may be plural portions whose distances from the anode terminal 4 are the shortest. In such a case, the two lead-out portions 51 and 52 are preferably provided with the portions B1 and B2 being disposed therebetween.

Figure 4C:
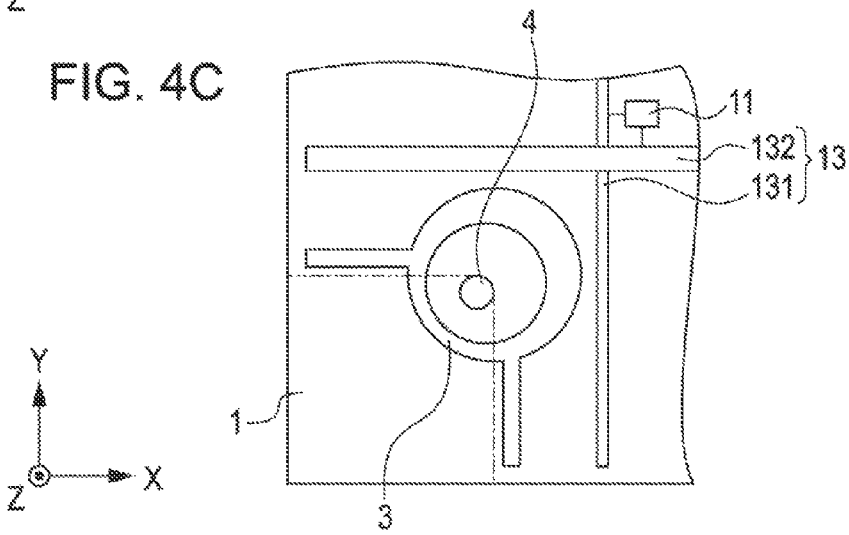

As illustrated in FIG. 4C, the cross section of a portion of the conductive member 3, which is positioned between the wiring 13 and the anode terminal 4, is preferably enlarged to be greater than the cross sections of the other portions. By enlarging the cross section, thermal capacity, resistance, and mechanical strength are improved, and breaking of the portion positioned between the wiring 13 and the anode terminal 4 can be suppressed. In view of the convenience of fabrication of the conductive member 3, the film thickness is preferably made equal in the entire conductive member 3, and only the width of the conductive member 3 is preferably made different.

In an embodiment of the present invention, a pressure-tight structure for suppressing discharge is preferably provided in the vicinity of the anode terminal 4. As an example of the pressure-tight structure, configurations described in Japanese Patent Laid-Open Nos. 2007-109603 and 2006-222093 may be used.

The inner edge of the conductive member 3 is preferably covered with an insulating film. Accordingly, emission of electrons from the conductive member 3 is suppressed, and occurrence of discharge is suppressed. As a material of the insulating film, a material whose volume resistivity is $10^6$ Ωm or greater is preferably used, and a material whose relative dielectric constant ranges from 3 to 10 is preferably used.

Also, an antistatic film is preferably provided on the first substrate 1 between the conductive member 3 and the anode terminal 4. Accordingly, electrification of the surface of the first substrate 1 can be suppressed, and discharge can be suppressed. The sheet resistance of the antistatic film is preferably $10^7$ Ω/□ or greater and $10^{14}$ Ω/□ or less. A material made of a metal nitride, oxide, or carbide may be used.

Also, at least one of an insulating depressed structure and an insulating protruding structure (hereinafter referred to as a "depressed-protruding structure") is preferably provided on the first substrate 1 between the conductive member 3 and the anode terminal 4. Accordingly, the creeping distance can be increased, and discharge can be suppressed. The depressed-protruding structure may be a periodical structure or a random structure. A depressed structure may be formed by providing a recess. A protruding structure may be formed by providing an insulating member with $10^6$ Ωm or greater on the surface 101 of the first substrate 1. With a protruding structure, not only the creeping distance is increased, but also the protruding structure may function as a barrier against emitted electrons.

Figure 5A:
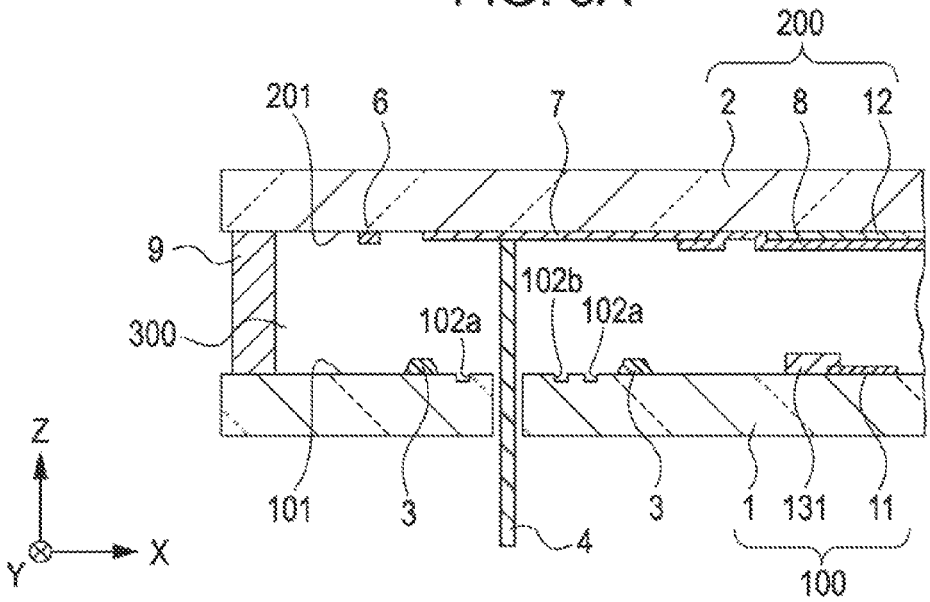
FIGS. 5A and 5B are schematic diagrams illustrating a display panel according to an embodiment of the present invention.
Figure 5B:
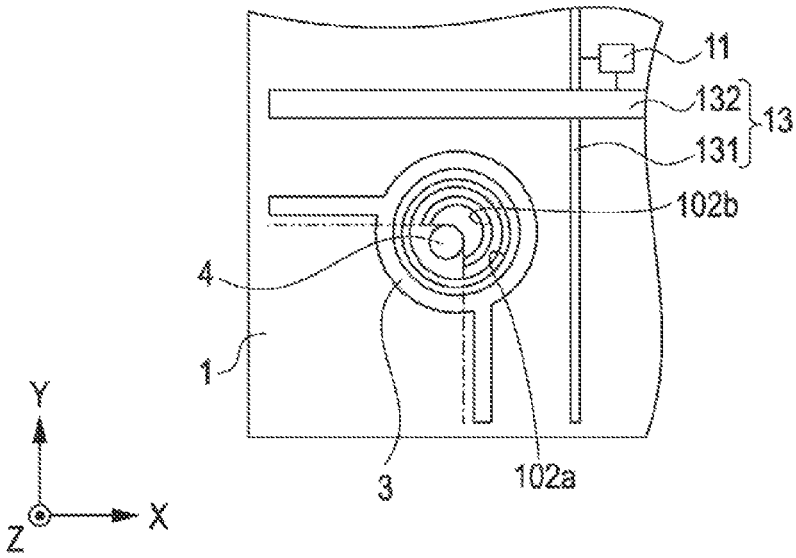

In FIGS. 5A and 5B, configurations in which the depressed-protruding structure is provided are illustrated. FIG. 5A is a cross-sectional view corresponding to FIG. 1B, and FIG. 5B is a plan view corresponding to FIG. 1C and FIG. 3B. Two recesses 102*a* and 102*b* are provided at positions closer to the wiring 13 than the anode terminal 4 is. The outer recess 102*a* is shaped to surround the anode terminal 4. In contrast, the inner recess 102*b* is provided only between the intermediate region and the anode terminal 4. Accordingly, the creeping distance between a portion of the conductive member 3 near the wiring 13 and the anode terminal 4 is elongated, compared with the configuration as illustrated in FIG. 1C in which no depressed-protruding structure is provided. Therefore, discharge (creeping discharge) in the portion near the wiring 13 can be further reduced.

The display panel 1000 will be further described. The pressure in the inner space 300 of the display panel 100 is preferably $1\times10^{-5}$ Pa or less. Also, a spacer (not illustrated) for defining the interval between the rear plate 100 and the face plate 200 may be provided.

Spint type, surface-conduction type, MIM type, or MIS type electron-emitting devices may be used as the electron-emitting devices 11, and the type is not particularly limited.

In the matrix wiring described so far, for illustrative purposes, it has been described that the column wiring 131 is connected to the gate of the electron-emitting device 11, and the row wiring 132 is connected to the cathode of the electron-emitting device 11. Also, it has been described that the column wiring 131 is below the row wiring 132. However, the column wiring 131 may be connected to the cathode of the electron-emitting device 11, and the row wiring 132 may be connected to the gate of the electron-emitting device 11. Also, the row wiring 132 may be below the column wiring 131. Also, the configurations in which the width of the column wiring 131 is less than the width of the row wiring 132 have been illustrated. However, the width of the column wiring 131 may be greater than the width of the row wiring 132, or the column wiring 131 and the row wiring 132 may have the same width.

When ladder-type wiring is used, a grid electrode for selecting at least one of multiple electron-emitting devices 11 connected to the first line 133 and the second line 134 may be provided between the electron-emitting devices 11 and the anode 8.

The guard electrode 6 is provided on the surface 201 of the second substrate 2, at a distance from the connection electrode 7 and the anode 8, so as to surround the outer edge of the anode 8. The guard electrode 6 is preferably set to the ground potential. The guard electrode 6 is provided to set the potential in the vicinity of the anode 8.

In the display panel 1000, one pixel or sub-pixel may include a corresponding one of the electron-emitting devices 11 and the light-emitting members 12 disposed so as to face the electron-emitting device 11. Full-color display can be performed by constructing one pixel by arranging sub-pixels having light-emitting members 12 that exhibit red, green, and blue luminescent colors. A black matrix that defines sub-pixels and pixels may be provided on the surface 201 of the second substrate 2. Also, color filters may be provided between the light-emitting members 12 and the second substrate 2.

Next, the display apparatus will be described in detail. As described above, the display apparatus at least includes the display panel 1000, the anode-potential setting unit 20, the prescribed-potential setting unit 21, and the drive circuit for driving the electron-emitting devices 11.

As illustrated in FIG. 1A, the anode-potential setting unit 20 is electrically connected, in the outer space, to the anode terminal 4 of the display panel 1000. The anode-potential setting unit 20 is a unit for setting the anode potential Va with respect to the ground potential. Specifically, the anode-potential setting unit 20 is an electric circuit (power supply circuit) that can generate the anode potential Va. Typically, the anode-potential setting unit 20 includes a transformer or a rectifier that can generate the anode potential Va from a domestic alternating current (AC) power supply (e.g., 100 V).

As illustrated in FIG. 1C, the prescribed-potential setting unit 21 is electrically connected, in the outer space, to the lead-out portion 5. An electric circuit that is different from the drive circuit and that can generate a potential Vr that is less than the anode potential Va may be used as the prescribed-potential setting unit 21. However, when an electric circuit is used as the prescribed-potential setting unit 21, if discharge occurs, the electric circuit may break. Therefore, a ground line is preferably used as the prescribed-potential setting unit 21. In this case, the prescribed potential Vr is the ground potential.

Figure 7:
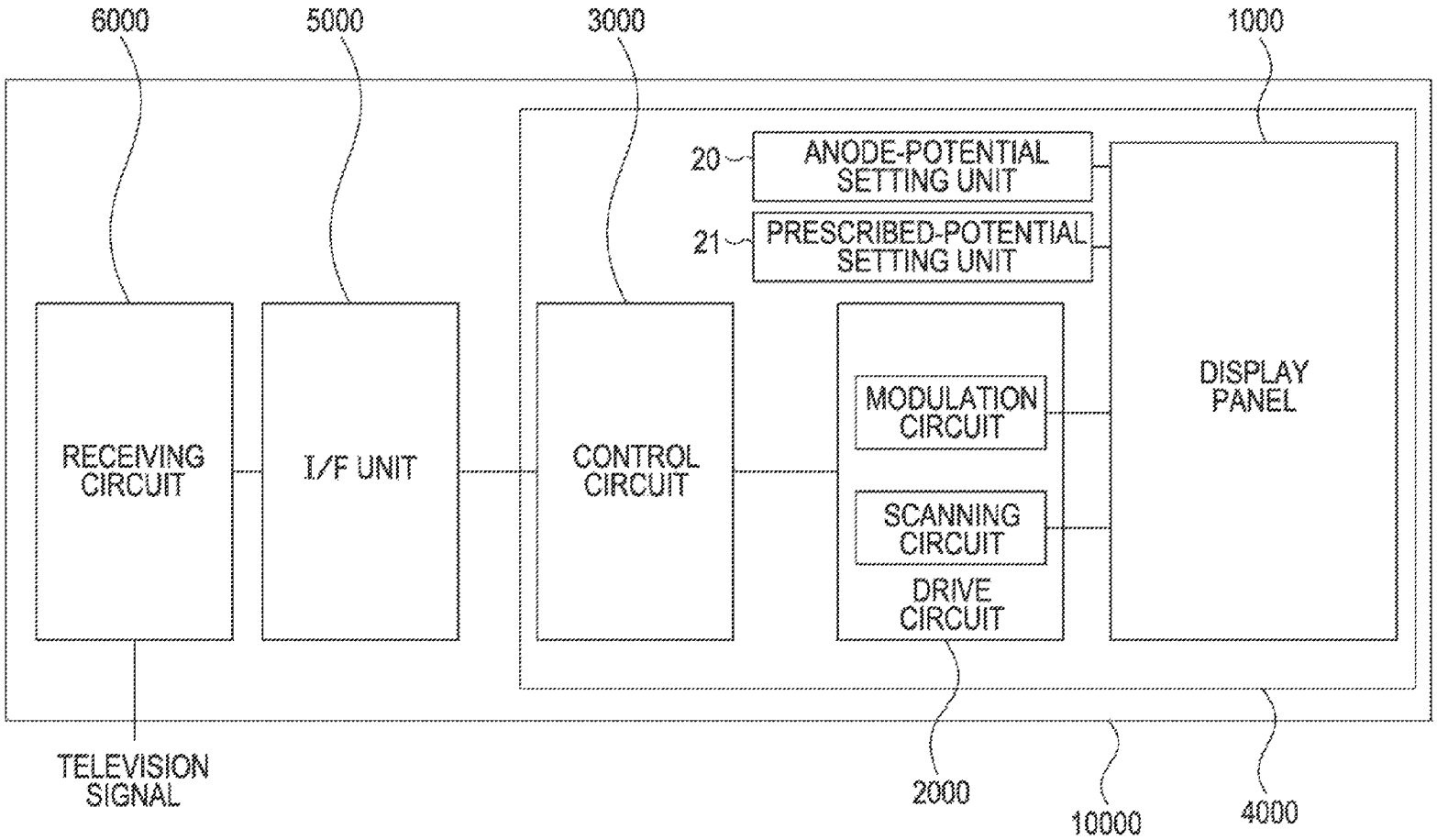
FIG. 7 is a block diagram illustrating a television apparatus according to an embodiment of the present invention.

The display panel 1000 of the embodiment of the present invention may be used in an image display apparatus that is a display apparatus for displaying an image or a television apparatus. FIG. 7 is a block diagram illustrating an example of an image display apparatus 4000 and an example of a television apparatus 10000.

A drive circuit 2000 including a scanning circuit and a modulation circuit may be used as a drive circuit used in the image display apparatus 4000. The image display apparatus 4000 can select and drive any electron-emitting device from among the electron-emitting devices 11, and cause the light-emitting members 12 to emit light at a desired gradation level. For example, the scanning circuit may be configured to include the cathode-potential setting unit 22, and the modulation circuit may be configured to include the gate-potential setting unit 23. Typically, the modulation circuit is connected to the column wirings 131, and the scanning circuit is connected to the row wirings 132. The scanning circuit outputs a scanning signal as the cathode potential Vg. The modulation circuit outputs a modulation signal as the gate potential Vg. The modulation signal is modulated in accordance with a display gradation level by using pulse-width modulation (PWM), pulse-amplitude modulation (PAM), or a modulation method combining PWM and PAM. The drive circuit 2000 performs line sequential scanning of the display panel 1000 in increments of row wiring 131. Typical line sequential scanning methods include a progressive method and an interlaced method. Since the frequency of a modulation signal is generally higher than the frequency of a scanning signal, noise on the modulation signal has a great effect on a display image. Therefore, preferably, the effect of discharge near the anode terminal 4 on wiring (e.g., column wiring 131) to which the modulation circuit is connected and a modulation signal is input is made preferentially smaller than the same effect on wiring (e.g., row wiring 132) to which the scanning circuit is connected and a scanning signal is input. The image display apparatus may include a control circuit 3000. The control circuit 3000 applies correction processing, suited for the display panel 1000, on an input image signal, and outputs the corrected image signal and various control signals to the drive circuit 2000. Correction processing includes, for example, inverse gamma correction. Based on the corrected image signal, the drive circuit 2000 outputs the scanning signal and the modulation signal as a drive signal to the display panel 1000.

The display panel 1000 of the embodiment of the present invention may be used in a television apparatus. FIG. 7 is a block diagram illustrating an example of the television apparatus 10000.

The television apparatus includes a receiving circuit 6000, an interface (I/F) unit 5000, and the image display apparatus 4000.

The receiving circuit 6000 receives a television signal including image information. A television signal can be received from broadcasting such as satellite broadcasting, terrestrial broadcasting, or cable-television, from communication such as the Internet or a video conference system, from an image input apparatus such as a camera or a scanner, or from an image storage apparatus such as a video recorder that stores image information. The receiving circuit 6000 may include a tuner and/or a decoder as needed. The receiving circuit 6000 outputs an image signal obtained by decoding the television signal to the I/F unit 5000.

The I/F unit 5000 converts the image signal into a display format of the image display apparatus 4000, and outputs the image signal to the image display apparatus 4000. Accordingly, an image in accordance with the television signal is displayed on the display panel 1000 of the image display apparatus 4000. According to the embodiment of the present invention, effects of discharge within the display panel 1000 are reduced. Therefore, a highly reliable television apparatus can be obtained.

EXAMPLE

In this Example, a display panel illustrated in FIGS. 1A to 1C was manufactured.

First, a glass substrate was prepared as the first substrate 1. The through hole 10*a* with a diameter of 2 mm was formed near the corner of the glass substrate 1. Multiple surface-conduction electron-emitting devices 11 were formed on the glass substrate 1 by using a known method.

The matrix wiring 13 (column wirings 131, inter-layer insulating layer (not illustrated), and row wirings 132) was formed on the glass substrate 1 by using a screen printing method that employs a Ag paste and a screen printing method that employs an insulating paste.

The circular conductive member 3 with an inside diameter of 10 mm, a width of 1 mm, an outside diameter of 12 mm, and a thickness of 10 μm was formed so as to surround the through hole 10*a* by using a screen printing method that employs a Ag paste. The conductive member 3 was formed so that the center of the inner periphery of the conductive member 3 was shifted by 0.5 mm from the center of the through hole 10*a*, in a direction of 45° (+X direction serves as 0°, and +Y direction serves as)90°. As illustrated in FIG. 3B, the lead-out portions 51 and 52 were formed at the same time. The lead-out portion 51 was formed in parallel with the column wiring 131 so as to have a width of 1 mm from the position at a further distance of 1.5 mm from the column wiring 131, compared with the portion (A1) of the inner edge of the conductive member 3 that is closest to the column wiring 131. The lead-out portion 52 was formed in parallel with the row wiring 132 so as to have a width of 1 mm from the position at a further distance of 1.5 mm from the row wiring 132, compared with the portion (A2) of the inner edge of the conductive member 3 that is closest to the row wiring 132.

In this manner, the rear plate 100 including the surface-conduction electron-emitting devices 11 and the matrix wiring 13 on the glass substrate 1 was fabricated.

Thereafter, the anode terminal 4 with a diameter of 1 mm was inserted into the through hole 10*a*. Since a material of the anode terminal 4 is preferably a material whose expansion coefficient is similar to that of the substrate (glass) in view of the mechanical strength, a 426 alloy was used. The anode terminal 4 was fixed to the side of the glass substrate 1, on which the matrix wiring 13 was provided, using the conductive sealant 10*b*. The through hole 10*a* was filled up using the sealant 10*b*. The sealant 10*b* was provided, around the through hole 10*a*, so as to have an outside diameter of 5 mm and to be concentric with the center of the through hole 10*a*. The minimum spatial distance (Rmin) between the conductive sealant 10*b* and the conductive member 3 was 2 mm, and the maximum spatial distance (Rmax) between the conductive sealant 10*b* and the conductive member 3 was 3 mm. Also, the spatial distances ($R_{A1}$ and $R_{A2}$) between the conductive sealant 10*b* and the portions closest to the wiring 13 were approximately 2.7 mm.

A transparent glass substrate was prepared as the second substrate 2. A conductive black member (black matrix) with an opening where the light-emitting members 12 are to be disposed was formed on the second substrate 2. Photosensitive carbon black was used as a material of the conductive black member, and the conductive black member had a thickness of 10 μm. The photosensitive carbon black was exposed to light and patterned so as to have an opening, and this opening of the conductive black member was filled with R, G, and B phosphors serving as the light-emitting members 12. By using a screen printing method, the phosphors of the three colors including R, G, and B were formed with a thickness of 10 μm in the opening of the conductive black member. As the anode 8, an aluminum film was deposited at a thickness of 100 nm on the entire surface of the conductive black member and the phosphors by using an evaporation method.

As above, the face plate 200 including the anode 8 and the light-emitting members 12 was fabricated on the glass substrate 2.

Next, a plate-shaped spacer that defines the interval between the rear plate 100 and the face plate 200 was prepared. With the spacer, the rear plate 100 and the face plate 200 were disposed facing each other, and the interval therebetween was defined to 1.6 mm. The rear plate 100 and the face plate 200 were joined using the frame member 9 being provided therebetween. Joining portions were hermetically sealed using low melting point metal.

From the interior of the hermetically-sealed container fabricated as above, air was pumped out through an exhaust hole provided in the hermetically-sealed container. Thereafter, the exhaust hole was sealed, so that the inner space 300 was maintained as a vacuum. Accordingly, the display panel 1000 was obtained. A power supply that can generate a voltage at 10 kV or greater was connected to the anode terminal 4 of the display panel 1000.

The wiring 13 and the lead-out portions 51 and 52 were grounded, and a potential of +30 kV was applied to the anode terminal 4. As a result, discharge occurred during a boosting operation. After a certain time had elapsed, the boosting operation was repeated. It was observed that, when discharge was caused to occur 10 times, the discharge occurred at all times near the corner of the display panel 1000, rather than near the anode terminal 4. It was also observed that, when discharge was caused to occur a certain number of times, potential generated as a result of the discharge was increased. From this point, it can be regarded that a conditioning effect was achieved as a result of discharge.

It was also observed that, when discharge occurred a certain number of times, current always flowed through the lead-out portions 51 and 52. However, current flowing through the column wiring 131 or the row wiring 132 was hardly observed.

Thereafter, +12 kV was applied to the anode terminal 4, and the electron-emitting devices 11 were driven to cause the phosphors to emit light. No discharge was observed within one hour or more, and favorable display was achieved. Further, +16 kV was applied to the anode terminal 4 to cause the phosphors to emit light. Discharge occurred during display, but effects on the display quality were hardly observed.

COMPARATIVE EXAMPLE

As a comparative example, the conductive member 3 was formed concentrically with the through hole 10*a*, and the display apparatus was fabricated. Since only the positional relationship among the conductive member 3, the matrix wiring 13, and the anode terminal 4 is different from that in the Example, and the positional relationship between the anode terminal 4 and the matrix wiring 13 and the other manufacturing methods are the same as those in the Example, repeated descriptions are omitted.

The circular conductive member 3 with an inside diameter of 10 mm, a width of 1 mm, an outside diameter of 12 mm, and a thickness of 10 μm was formed so as to surround the through hole 10*a* by using a screen printing method that employs a Ag paste. The conductive member 3 was formed so that the center of the inner periphery of the conductive member 3 becomes concentric with the center of the outer periphery of the through hole 10*a*.

The lead-out portion 51 was formed in parallel with the column wiring 131 so as to have a width of 1 mm from the position at a further distance of 0.5 mm from the column wiring 131, compared with the portion (A1) of the inner edge of the conductive member 3 that is closest to the column wiring 131. The lead-out portion 52 was formed in parallel with the row wiring 132 so as to have a width of 1 mm from the position at a further distance of 0.5 mm from the row wiring 132, compared with the portion (A2) of the inner edge of the conductive member 3 that is closest to the row wiring 132.

The sealant 10*b* was provided, around the through hole 10*a*, so as to have an outside diameter of 5 mm and to be concentric with the center of the through hole 10*a*. The distance between the conductive sealant 10*b* and the conductive member 3 was 2.5 mm in all directions.

As in the Example, when discharge was caused to occur 10 times, discharge occurred at a position at a greater distance from the matrix wiring 13 than the anode terminal 4 is, and discharge also occurred at a position closer to the matrix wiring 13 than the anode terminal 4 is. That is, discharge occurred at different positions. Compared with the Example, the conditioning effect was small.

It was also observed that, when discharge occurred a certain number of times, current always flowed through the lead-out portions 51 and 52. Also, large current sometimes flowed through the column wiring 131 and the row wiring 132.

Thereafter, +12 kV was applied to the anode terminal 4, and the electron-emitting devices 11 were driven to cause the phosphors to emit light. Although no discharge was observed within one hour or more, the luminance levels of some pixels corresponding to the column wiring 131 near the anode terminal 4 were lower than those of pixels of columns corresponding to the other column wirings 131. This resulted in a streaky dark line. Further, +16 kV was applied to the anode terminal 4 to cause the phosphors to emit light. Discharge occurred during display, and, as a result of the discharge, effects on a display image were observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-149798, filed Jun. 24, 2009, and No. 2010-125990, filed Jun. 1, 2010, which are hereby incorporated by reference herein in their entirety.

What is claimed is:

1. A display panel comprising:

an insulating substrate;

an electron-emitting device and wiring connected to the electron-emitting device, the electron-emitting device and the wiring being positioned on the substrate;

an anode and a light-emitting member facing the electron-emitting device at a distance from the substrate;

a terminal that penetrates through the substrate and is electrically connected to the anode; and a conductive member whose part is positioned in a region between the wiring and the terminal, the conductive member being positioned on the substrate so as to surround the terminal, wherein the terminal is arranged to be set to an anode potential, and the conductive member is arranged to be set to a potential, which is lower than the anode potential, wherein the conductive member includes, at an inner edge thereof, a plurality of portions whose distances from the terminal are different, and the plurality of portions include a portion whose distance from the terminal is shorter than that of a portion that is closest to the wiring among the plurality of portions, and wherein the conductive member includes a lead-out portion that extends from the inner edge toward an edge of the substrate, and the lead-out portion extends at a greater distance from the wiring than that of the portion that is closest to the wiring.

2. The display panel according to claim 1, wherein a portion whose distance from the terminal is the shortest among the plurality of portions is positioned outside the region between the wiring and the terminal.

3. The display panel according to claim 1, wherein the lead-out portion extends from at least two portions among the plurality of portions toward the edge of the substrate, and wherein one of the at least two portions is positioned on one of two paths connecting, along the inner edge, the portion whose distance from the terminal is shortest and the portion that is closest to the wiring, and the other one of the at least two portions is positioned on the other one of two paths.

4. The display panel according to claim 3, wherein the at least two portions are positioned in the region between the wiring and the terminal.

5. The display panel according to claim 1, wherein the wiring includes column wiring and row wiring that intersect each other, wherein the portion that is closest to the wiring includes a first portion that is closest to the column wiring among the plurality of portions, and a second portion that is closest to the row wiring among the plurality of portions, wherein the plurality of portions include a portion whose distance from the terminal is shorter than that of the first portion and that of the second portion, and wherein the portion whose distance from the terminal is shortest is positioned on one of two paths connecting, along the inner edge of the conductive member, the first portion and the second portion, the one of the two paths being farther away from the column wiring or the row wiring.

6. The display panel according to claim 5, wherein the portion whose distance from the terminal is shortest is positioned outside a region between the column wiring and the terminal and outside a region between the row wiring and the terminal.

7. The display panel according to claim 5, wherein the conductive member includes a lead-out portion that extends from the inner edge toward an edge of the substrate, and wherein the lead-out portion extends at a greater distance from the column wiring than that of the first portion, and at a greater distance from the row wiring than that of the second portion.

8. The display panel according to claim 7, wherein the lead-out portion extends from at least two portions among the plurality of portions toward the edge of the substrate, wherein one of the at least two portions is positioned on one of two paths connecting, along the inner edge, the portion whose distance from the terminal is shortest and the first portion, not including the second portion, and wherein the other one of the at least two portions is positioned on one of two paths connecting, along the inner edge, the portion whose distance from the terminal is shortest and the second portion, not including the first portion.

9. The display panel according to claim 8, wherein the at least two portions are respectively positioned in a region between the column wiring and the anode terminal and in a region between the row wiring and the terminal.

10. The display panel according to claim 5, wherein the inner edge of the conductive member is circular, an outer edge of the anode terminal is circular, and a center of the outer edge of the terminal is not coincident with the center of the inner edge of the conductive member.

11. The display panel according to claim 1, wherein the inner edge of the conductive member is circular, an outer edge of the terminal is circular, and a center of the outer edge of the terminal is not coincident with the center of the inner edge of the conductive member.

12. An apparatus comprising:

a display panel according to claim 1;

a first unit configured to set the anode potential, the first unit being connected to the terminal;

a second unit configured to set the potential lower than the anode potential, the second unit being connected to the conductive member; and a drive circuit configured to drive the electron-emitting device, the drive circuit being connected to the wiring.

13. The apparatus according to claim 12, wherein the wiring includes column wiring and row wiring that intersect each other, wherein the portion that is closest to the wiring includes a first portion that is closest to the column wiring among the plurality of portions, and a second portion that is closest to the row wiring among the plurality of portions, wherein the plurality of portions include a portion whose distance from the terminal is shorter than that of the first portion and that of the second portion, and wherein the portion whose distance from the terminal is shortest is positioned on one of the two paths connecting, along the inner edge of the conductive member, the first portion and the second portion, the one of the two paths being farther away from the column wiring or the row wiring.

14. An apparatus comprising:

a receiving circuit configured to receive a television signal; and a display panel configured to display an image in accordance with the television signal, wherein the display panel is a display panel according to claim 1.

15. The apparatus according to claim 14, wherein the wiring includes column wiring and row wiring that intersect each other, wherein the portion that is closest to the wiring includes a first portion that is closest to the column wiring among the plurality of portions, and a second portion that is closest to the row wiring among the plurality of portions, wherein the plurality of portions include a portion whose distance from the terminal is shorter than that of the first portion and that of the second portion, and wherein the portion whose distance from the terminal is shortest is positioned on one of the two paths connecting, along the inner edge of the conductive member, the first portion and the second portion, the one of the two paths being farther away from the column wiring or the row wiring.

16. A display apparatus comprising:

an insulating substrate;

an electron-emitting device positioned on the substrate;

a column wiring and a row wiring each connected to the electron-emitting device, the column wiring and the row wiring intersect each other being positioned on the substrate;

an anode and a light-emitting member facing the electron-emitting device at a distance from the substrate;

a terminal that penetrates through the substrate and is electrically connected to the anode;

a conductive member whose part is positioned in a region between the column wiring and the terminal and between the row wiring and the terminal, the conductive member being positioned on the substrate so as to surround the terminal;

a first unit configured to set an anode potential, the first unit being connected to the terminal;

a second unit configured to set an potential lower than the anode potential, the second unit being connected to the conductive member; and a driving circuit including a modulation circuit connected to the column wiring and including a scanning circuit connected to the column wiring, the driving circuit configured to drive the electron-emitting device, wherein the conductive member has a lead-out portion that extends from an inner edge toward an edge of the substrate, and an end of the lead-out portion being connected to the second unit, and the inner edge includes a first point that is closest to the column wiring in the inner edge, and include a second point that is closest to the row wiring in the inner edge, wherein the lead-out portion extends at a greater distance from the column wiring than that of the first point and extends at a greater distance from the row wiring than that of the second point, and the lead-out portion does not extend closer to the column wiring than the first point and does not extend closer to the row wiring than the second point, and wherein the inner edge of the conductive member is circular, and the row wiring and the column wiring are positioned so that an angle formed by the column wiring and the row wiring, each facing the conductive member, becomes greater than 90°.

17. The display apparatus according to claim 16 wherein a cross section of at least part of the column wiring is smaller than a cross section of the row wiring, and the lead-out portion extends not in parallel with the row wiring.

18. A television apparatus comprising:

a receiving circuit configured to receive a television signal; and a display apparatus configured to display an image in accordance with the television signal, wherein the display apparatus is a display apparatus according to claim 16.

* * * * *